US009828938B2

(12) United States Patent
Suda et al.

(10) Patent No.: US 9,828,938 B2
(45) Date of Patent: Nov. 28, 2017

(54) PISTON FOR INTERNAL COMBUSTION ENGINES

(71) Applicants: SUZUKI MOTOR CORPORATION, Shizuoka (JP); National University Corporation Shizuoka University, Shizuoka (JP)

(72) Inventors: Naoyuki Suda, Shizuoka (JP); Kunio Hayakawa, Shizuoka (JP)

(73) Assignees: SUZUKI MOTOR CORPORATION, Shizuoka (JP); NATIONAL UNIVERSITY CORPORATION SHIZUOKA UNIVERSITY, Shizuoka (JP)

( * ) Notice: Subject to any disclaimer, the term of this patent is extended or adjusted under 35 U.S.C. 154(b) by 14 days.

(21) Appl. No.: 15/163,405

(22) Filed: May 24, 2016

(65) Prior Publication Data

US 2016/0348611 A1 Dec. 1, 2016

(30) Foreign Application Priority Data

May 25, 2015 (JP) ..... 2015-105538

(51) Int. Cl.
*F02F 3/10* (2006.01)
*F02F 3/28* (2006.01)
*F02F 3/02* (2006.01)

(52) U.S. Cl.
CPC ..... *F02F 3/10* (2013.01); *F02F 3/022* (2013.01); *F02F 3/28* (2013.01); *F05C 2225/00* (2013.01)

(58) Field of Classification Search
CPC ..... F02F 3/10; F02F 3/105; F02F 3/28; F02F 3/285; F02F 3/02; F02F 3/022; F02F 3/025; F02F 3/027
See application file for complete search history.

(56) References Cited

U.S. PATENT DOCUMENTS 8,640,669 B2 2/2014 Nakazawa et al.
2011/0139114 A1 6/2011 Nakazawa et al.
2016/0312739 A1* 10/2016 Oso ..... F02F 3/0084

FOREIGN PATENT DOCUMENTS

JP 4749398 B2 8/2011

* cited by examiner

*Primary Examiner* — Jacob Amick
(74) *Attorney, Agent, or Firm* — Rothwell, Figg, Ernst & Manbeck, P.C.

(57) ABSTRACT

A resin coat film 39 formed on a skirt portion 10 of a piston 7 has a four-sided outer peripheral region knurled at upper and lower regions thereof corresponding in a rear view of the piston 7 to an upper skirt part 36 and a lower skirt part 38 of the skirt portion 10 extending in parallel with an axial direction of left and right piston pin boss portions 15 and 14, with a combination of short vertical grooves 43A and 43B and medium-length vertical grooves 42A and 42B extending in parallel with a central axis C of a piston crow portion 9, and at left and right edge regions thereof, with long vertical grooves 41.

5 Claims, 14 Drawing Sheets

PISTON FOR INTERNAL COMBUSTION ENGINES

CROSS-REFERENCE TO RELATED APPLICATION

This application is based upon and claims the benefit of priority from Japanese Patent Application No. 2015-105538, filed May 25, 2015, the entire contents of which are incorporated herein by reference.

BACKGROUND OF INVENTION

Technical Field

This invention relates to pistons for internal combustion engines, and specifically, to pistons for internal combustion engines including skirt portions adapted to slide relative to a wall of a cylinder bore.

Background Techniques

As a piston adapted to reciprocate relative to a wall of a cylinder bore in an internal combustion engine, there has been known one disclosed in JP 4,749,398. This piston includes a skirt body having a pair of skirt portions hanging down therefrom, a pair of side wall portions interconnecting the paired skirt portions with each other, and a pair of piston pin boss portions provided at the paired side wall portions for holding a piston pin.

The skirt portions are formed in a barrel shape including a piston-axially central part having a largest outside diameter in consideration of effects of thermal expansion. The skirt portions each have a resin coat film formed thereon.

Further, the skirt portions each have an outer periphery including left and right peripheral regions thrust-directionally covered with lateral stripe-shaped films allowing for favorable lubrication, thereby preventing the piston from seizing at such locations on a cylinder.

SUMMARY OF INVENTION

Such the piston for internal combustion engines in the past is provided, at both circumferential sides of each skirt portion, with side wall portions connected to the piston pin boss portions serving to support a piston pin that transmits combustion pressures to a connecting rod.

By doing so, both sides of the skirt portions connected to side wall portions have decreased tendencies to deform, accompanied by increased contact pressures (in terms of a pressure per unit area) acting on the skirt portions to press against the wall of the cylinder bore. On the other hand, lower parts of the skirt portions involving low rigidities and tendencies to elastically deform have moderated low contact pressures.

Therefore, when the piston reciprocates, each skirt portion has parts of such combustion pressures imposed thereon from the piston pin. In due course, the skirt portion contact the wall of the cylinder bore, when the skirt portion has a surface thereof involving those regions undergoing high contact pressures and those regions undergoing low contact pressures.

In addition thereto, the skirt portions formed in a barrel shape have small clearances between the cylinder bore and local regions having a largest diameter in piston-axially central parts, and large clearances between the cylinder bore and piston-axially upper and lower parts relative to the central parts.

In this regard, there may be situations involving arrays of pits formed with an even depth at locations undergoing large contact pressures and locations undergoing small contact pressures, on a resin coat film at each skirt portion. Such arrays of pits are effective to introduce oil to pits, and adapted for oil to flow out of pits, acting on oil films, making the thickness thinner, thus causing the skirt portion to contact the wall of the cylinder bore with increased contact pressures. Hence, when running at low speeds, there can be anxieties about insufficient oil supply causing non-conforming lubrication at local parts of the skirt portion undergoing small clearances to the wall of the cylinder bore.

On the other hand, there can be local parts of the skirt portion contacting the wall of the cylinder bore with decreased contact pressures, undergoing increased clearances to the wall of the cylinder bore, with anxieties about excessive oil supply. In such situations, the piston is to reciprocate on the wall of the cylinder bore, in manners of scraping oil at the piston-axially upper and lower parts relative to the central part of the piston.

As a result, there can be fluxes of oil constituting resistances, causing piston shearing resistances, that is, piston dragging resistances to be increased, with anxieties about degraded fuel economy.

This invention has been devised in view of such problems.

It therefore is an object of this invention to provide a piston for internal combustion engines adapted for favorable lubrication between the piston and a wall of a cylinder bore, allowing for reduced piston dragging resistances by oil.

According to aspects of this invention, there is provided a piston for internal combustion engines including a piston body, a pair of skirt portions hanging down from the piston body, a pair of piston pin boss portions hanging down from the piston body and configured to hold a piston pin, a pair of side wall portions configured to interconnect the pair of skirt portions and the pair of piston pin boss portions, and a resin coat film provided on an outer periphery of one skirt portion of the pair of skirt portions. The one skirt portion includes a central skirt part having an outside diameter thereof maximized at a central part thereof with respect to an extending direction of a central axis of the piston body, an upper skirt part residing above an upper boundary of the central skirt part, and curved to have an outside diameter thereof gradually decreased, as the upper skirt part extends from the upper boundary toward the central axis of the piston body, and a lower skirt part residing below a lower boundary of the central skirt part, and curved to have an outside diameter thereof gradually decreased, as the lower skirt part extends from the lower boundary toward the central axis of the piston body. The one skirt portion is configured to have increased curvatures, as the one skirt portion circumferentially extends from a circumferential central region on the one skirt portion toward the pair of side wall portions. The resin coat film includes a region thereon corresponding to a combination involving at least the upper skirt part and the lower skirt part, the region on the resin coat film being knurled with a set of vertical grooves extending in parallel with the central axis of the piston body. The set of vertical grooves resides within an outer peripheral range of the resin coat film corresponding to extending directions of the pair of piston pin boss portions with respect to a direction perpendicular to the central axis of the piston body.

According to the aspects of this invention, there can be achieved adaptation for enhanced lubrication between a piston and a wall of a cylinder bore, allowing for reduced piston dragging resistances by oil.

DESCRIPTION OF EMBODIMENTS

There will be described pistons for internal combustion engines according to embodiments of this invention, with reference to the drawings.

The drawings include FIGS. 1 to 14 as figures describing a piston for internal combustion engines according to an embodiment of this invention.

It is noted that FIGS. 1 to 9 and FIGS. 11 to 13 each carries a combination of arrowed frontward, rearward, rightward, and/or upward senses indicating corresponding senses of vehicle-longitudinal, vehicle-transverse, and vehicle-vertical directions identified in a field of vision at a driver's seat in an associated vehicle.

Description is now made of configuration of an internal combustion engine involved in this embodiment.

Figure 1:
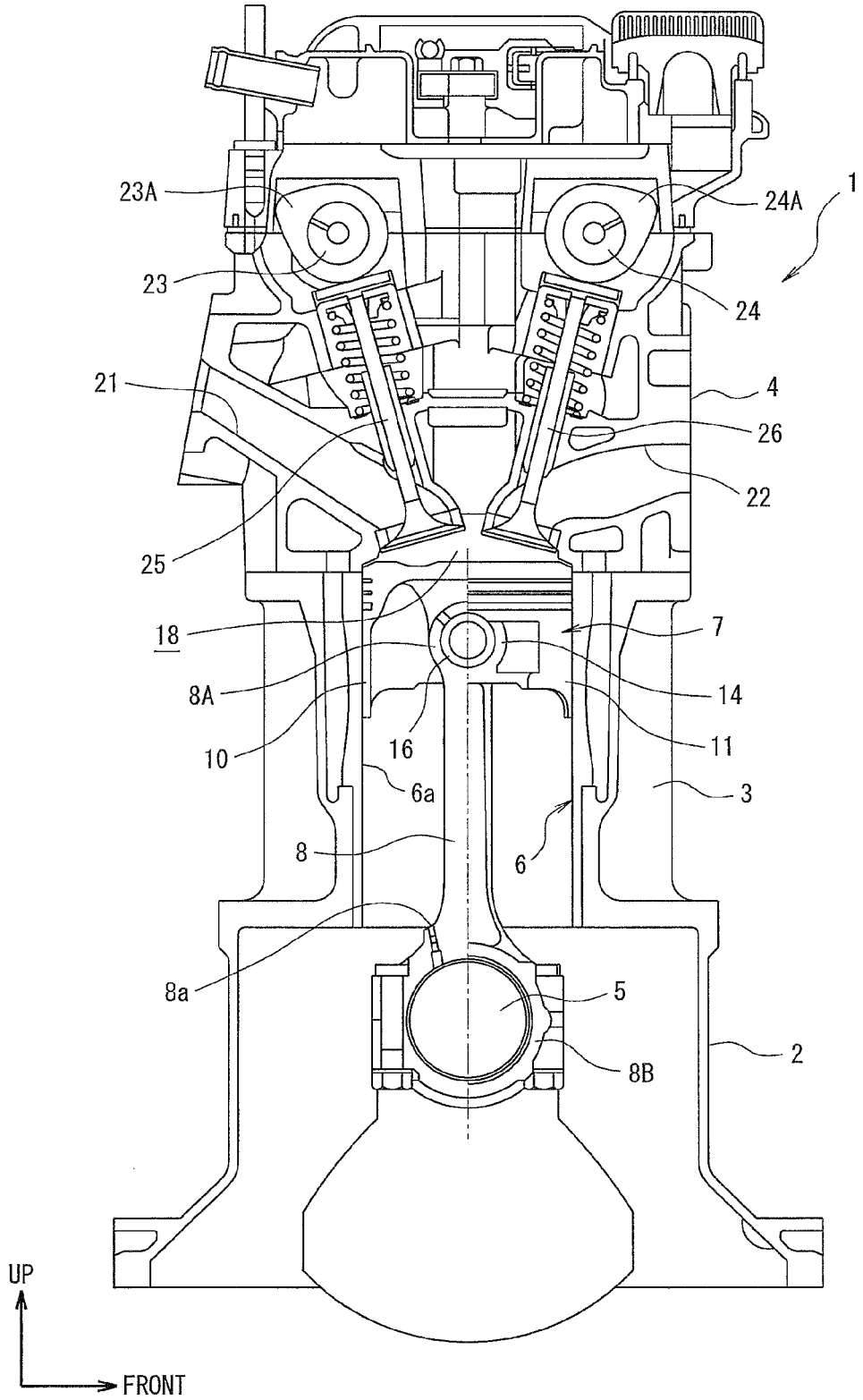
FIG. 1 is a cross-sectional right side view of an internal combustion engine, as a figure showing a piston for internal combustion engines according to an embodiment of this invention.

FIG. 1 illustrates an engine 1 as the involved internal combustion engine mounted on the associated vehicle. The engine 1 is made up including a cylinder block 3 having a crankcase 2 integrated therewith, and a cylinder head 4 provided at an upper portion of the cylinder block 3.

The cylinder block 3 includes a set of cylinder bores 6 arrayed vehicle-transversely (i.e., overlapped when viewed vehicle-transversely), having one-to-one corresponding pistons 7 individually accommodated therein, respectively. The pistons 7 are made of an aluminum alloy or the like. The pistons 7 are each adapted to vertically reciprocate relative to an associated cylinder bore 6.

The pistons 7 are respectively connected by one-to-one corresponding connecting rods 8 to a common crankshaft 5, for adaptation to convert reciprocal motions of the pistons 7 into rotary motions of the crankshaft 5 through the connecting rods 8.

Here, at the engine 1, the cylinder bores 6 are provided in correspondence to the cylinder number of the engine 1. For instance, when assuming the engine 1 to be a 4-cylinder engine, the engine 1 has four cylinder bores 6.

In the example illustrated in FIG. 1, the engine 1 is made up as a 4-cylinder engine. However, according to embodiments herein, the engine 1 may well have an arbitrary specific cylinder number without restriction to 4. Moreover, the engine 1 may well be made up as another type of engine, such as a gasoline engine, or a diesel engine. Further, the type of the engine 1 is not restricted thereto.

The engine 1, being a 4-cylinder engine, includes four cylinder bores 6 that have an identical configuration, and four pistons 7 that have an identical configuration, the pistons 7 being fit in the cylinder bores 6, respectively. Depicted in FIG. 1 is a combination of a specific cylinder bore 6 and a specific piston 7 fit therein. Description will be made the specific piston 7 fit in the specific cylinder bore 6.

Figure 2:
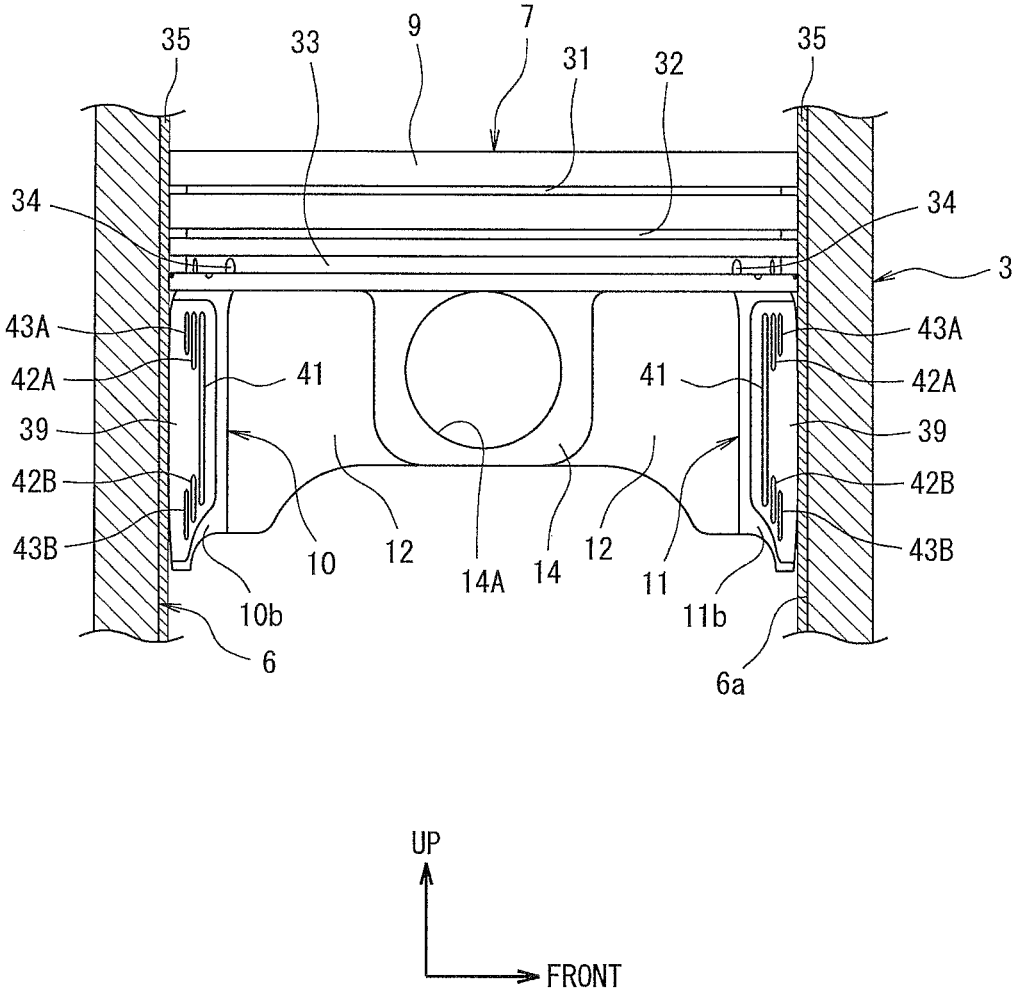
FIG. 2 is a right side view of a piston fit in a cylinder bore of the internal combustion engine, as a figure showing a piston for internal combustion engines according to the embodiment of this invention.
Figure 5:
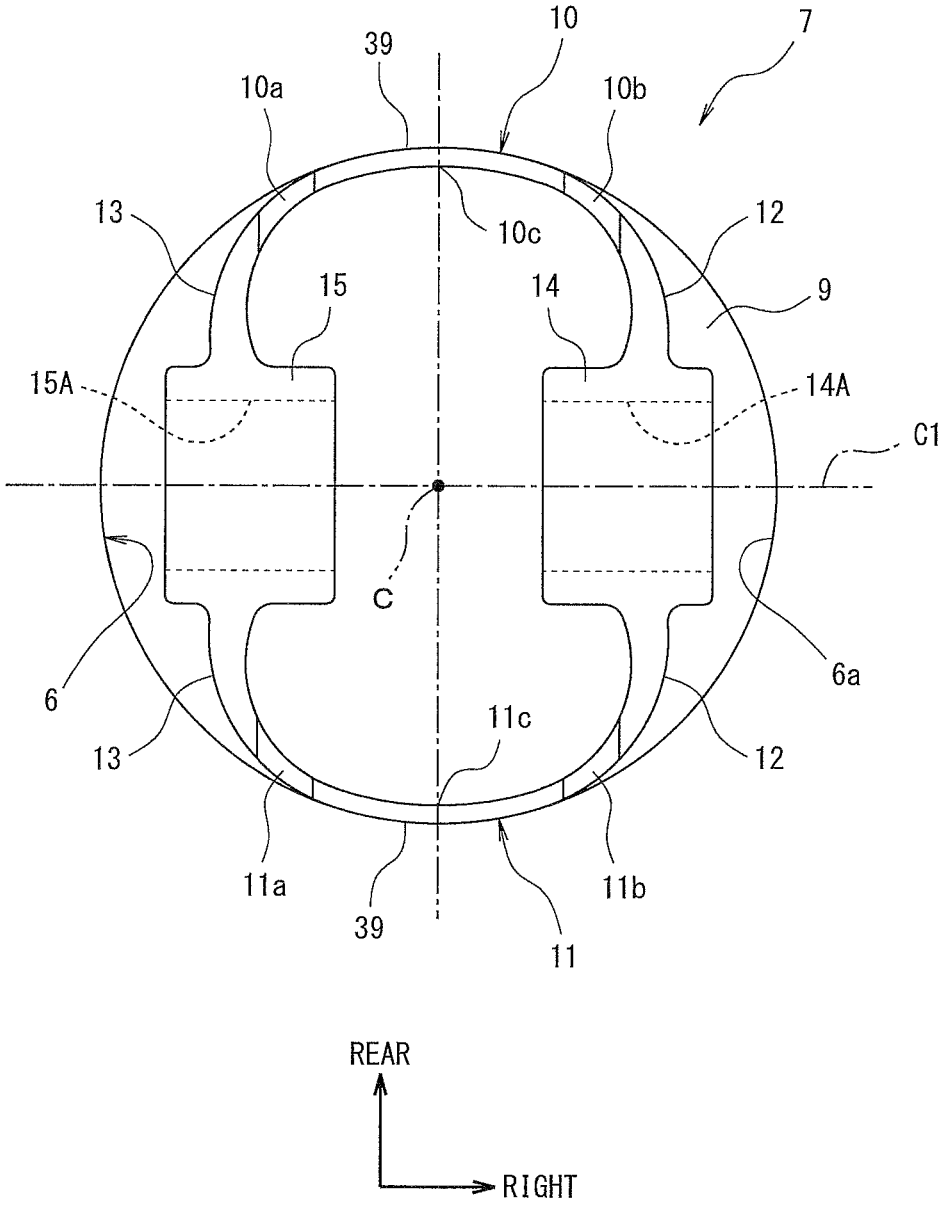
FIG. 5 is a bottom view of the piston fit in the cylinder bore, as a figure showing a piston for internal combustion engines according to the embodiment of this invention.
Figure 6:
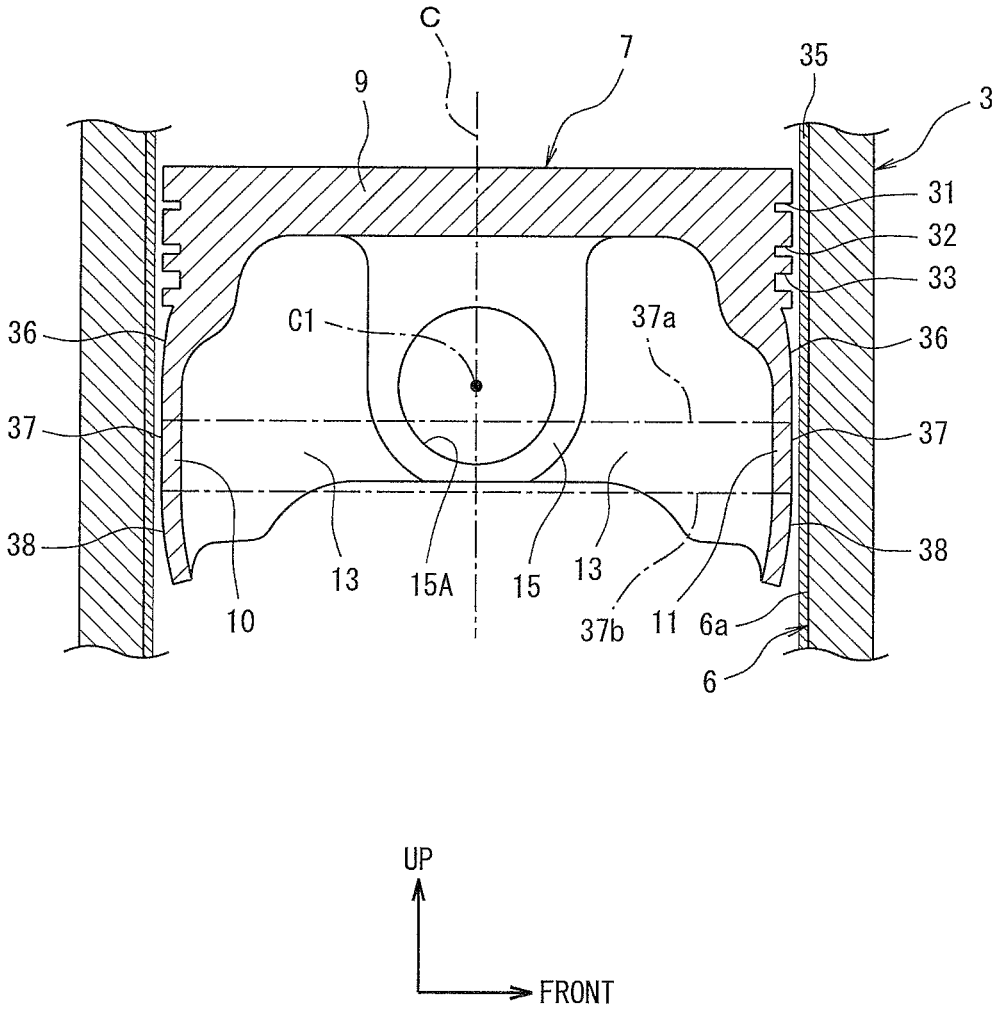
FIG. 6 is a longitudinal sectional view along a IV-IV arrowed cut plane in FIG. 3 (i.e., viewed from the right side) of the piston fit in the cylinder bore, as a figure showing a piston for internal combustion engines according to the embodiment of this invention.

The piston 7 fit in the cylinder bore 6 has a lateral side shown in FIG. 2, as it is viewed from the right side, and a longitudinal section shown in FIG. 6, as it is viewed from the right side. The piston 7 has a rear side shown in FIG. 3, a right side shown in FIG. 4, and a bottom side shown in FIG. 5.

As will be seen from FIGS. 2 to 6, the piston 7 has a piston crown portion 9 adapted to vertically reciprocate relative to a whole circumference of a wall 6*a* being an inner peripheral wall of the cylinder bore 6, and a pair of front and rear skirt portions 11 and 10 hanging down from the piston crown portion 9. Here, according to embodiments herein, the piston crown portion 9 constitutes a piston body according to this invention.

Figure 3:
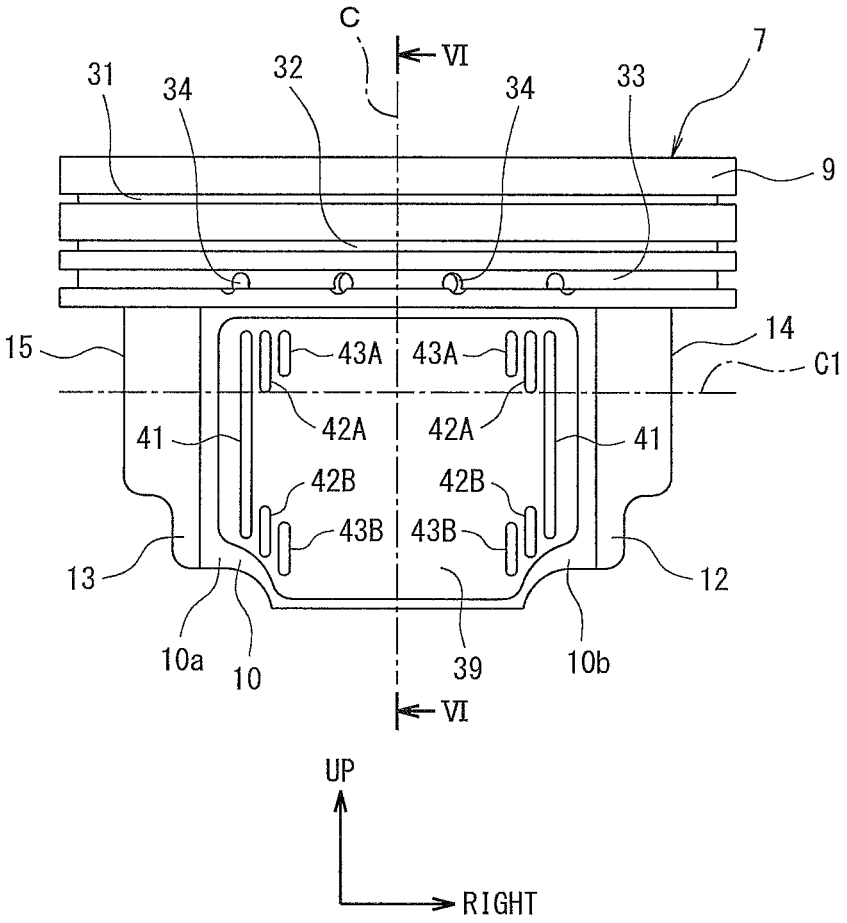
FIG. 3 is a rear view of the piston viewed from the side of a driver's seat in an involved vehicle, as a figure showing a piston for internal combustion engines according to the embodiment of this invention.

The piston 7 has a pair of left and right piston pin boss portions 15 and 14 hanging down from the piston crown portion 9, for cooperatively holding a vehicle-transversely extending piston pin 16 (see FIG. 1) to be rotatable about a central axis C1 thereof (see FIGS. 3 and 5).

Further, the piston 7 has a combination of a left pair of front and rear side wall portions 13 and 13 (see FIG. 6) and a right pair of front and rear side wall portions 12 and 12 (see FIG. 2), disposed for interconnecting the front and rear skirt portions 11 and 10 and the left and right piston pin boss portions 15 and 14.

Specifically, the piston 7 has four side walls 13, 13 and 12, 12 (see FIG. 5) being:

- a left front side wall portion 13 for interconnecting a left side part 11*a* of the front skirt portion 11, a front edge part of the left piston pin boss portion 15, and an associated part of a lower bottom part of the piston crown portion 9;
- a left rear side wall portion 13 for interconnecting a left side part 10*a* of the rear skirt portion 10, a rear edge part of the left piston pin boss portion 15, and an associated part of the lower bottom part of the piston crown portion 9;
- a right front side wall portion 12 for interconnecting a right side part 11*b* of the front skirt portion 11, a front edge part of the right piston pin boss portion 14, and an associated part of the lower bottom part of the piston crown portion 9; and
- a right rear side wall portion 12 for interconnecting a right side part 10*b* of the rear skirt portion 10, a rear edge part of the right piston pin boss portion 14, and an associated part of the lower bottom part of the piston crown portion 9.

As will be seen from FIG. 1, the piston pin 16 is formed in a cylindrical shape, and as shown in FIG. 3 or 5, the central axis C1 of the piston pin 16 extends in a perpendicular direction to a central axis C of the piston crown portion 9 and intake and exhaust directions.

Here, as shown in FIG. 5, according to embodiments herein, the left side parts 11*a* and 10*a* of the front and rear skirt portions 11 and 10 each correspond to one side in a circumferential direction of a skirt portion according to this invention, and the right side parts 11*b* and 10*b* of the front and rear skirt portions 11 and 10 each correspond to another side (i.e., an opposite side to the one side) in the circumferential direction of the skirt portion according to this invention.

It is noted that, as will be seen from FIGS. 2 to 6, the left side parts 11*a* and 10*a* as well as the right side parts 11*b* and 10*b* each have a prescribed circumferential length or width from a corresponding one of left ends or right ends of the front and rear skirt portions 11 and 10, respectively.

As shown in FIG. 2, 5, or 6, the left and right piston pin boss portions 15 and 14 respectively have left and right piston pin application holes 15A and 14A for the piston pin 16 to be fit therein. The piston pin 16 is inserted through the left and right piston pin application holes 15A and 14A, and supported by the left and right piston pin boss portions 15 and 14.

As will be seen from FIG. 1, at the piston 7, the piston pin 16 is operatively connected to a small-diameter portion 8A of an associated connecting rod 8, and a large-diameter portion 8B of the connecting rod 8 is operatively connected to the crankshaft 5. By doing so, reciprocal motions of the piston 7 are converted into rotary motions of the crankshaft 5.

As will be seen from FIG. 1, at the engine 1, the cylinder head 4 has a set of intake ports 21 formed therein for individual fluid communication with the cylinder bores 6. Each cylinder bore 6 has a combustion chamber 18 defined between a top region of a wall 6*a* thereof and an associated piston 7. There can be fluxes of intake air introduced to the combustion chamber 18, through an associated intake port 12.

At the engine 1, the cylinder head 4 has a set of exhaust ports 22 formed therein for individual fluid communication with the cylinder bores 6. At each cylinder bore 6, there can be fluxes of exhaust gas produced in the combustion chamber 18 and discharged therefrom through an associated exhaust port 22.

As will be seen from FIG. 1, at the engine 1, the cylinder head 4 is provided with a combination of an intake camshaft 23 carrying a set of intake cams 23A, and an exhaust camshaft 24 carrying a set of exhaust cams 24A. Further, at the cylinder head 4, each cylinder bore 6 is provided with a combination of an intake valve 25 operable by an associated intake cam 23A to make or break fluid communication with the combustion chamber 18, and an exhaust valve 26 operable by an associated exhaust cam 23A to make or break fluid communication with the combustion chamber 18.

As shown in FIGS. 2 to 4 and 6, at the before-mentioned specific piston 7, the piston crown portion 9 has at an outer periphery thereof three ring grooves formed therein to be a first compression ring groove 31, a second compression ring groove 32, and an oil ring groove 33 in this order from the top.

At the above-noted piston 7, the first compression ring groove 31 and the second compression ring groove 32 have non-depicted annular first and second compression rings fit therein, respectively, and the oil ring groove 33 has a non-depicted annular oil ring fit therein as a piston ring.

The first compression ring groove 31 as well as the second compression ring groove 32 has a function of contacting a region on a wall 6*a* of the cylinder bore 6, to thereby seal tight the combustion chamber 18.

The oil ring has a function of contacting a region of the wall 6*a* of the cylinder bore 6, moving in accordance with a reciprocal movement of the piston 7, while scraping oil adhering on the region on the wall 6*a* of the cylinder bore 6.

Figure 4:
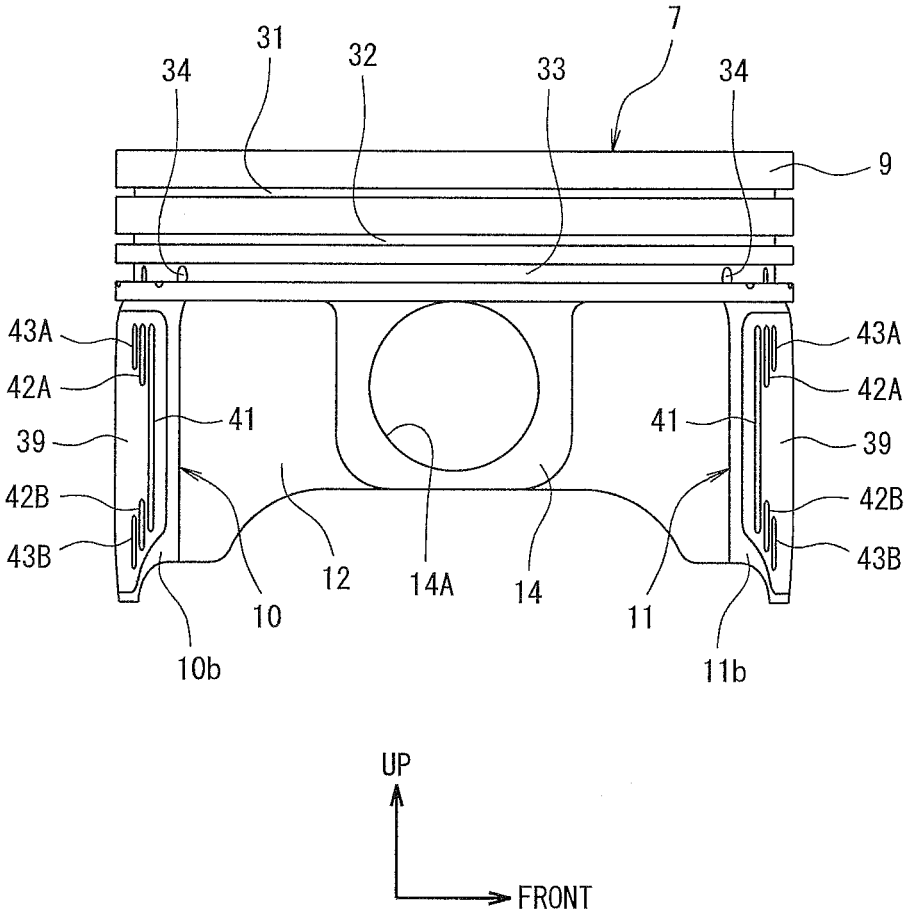
FIG. 4 is a right side view of the piston, as a figure showing a piston for internal combustion engines according to the embodiment of this invention.

Further, as shown in FIG. 2, 3, or 4, the oil ring groove 33 has a pair of front and rear sets of oil return holes 34 formed in a (radially inward) bottom thereof. Specifically, there is one set of oil return holes 34 (four locations, see FIG. 3) formed at each of a thrust side and a counter thrust side (i.e., one and the other of side thrust directions before and after a top dead center, specifically, the front and rear sides in FIG. 2) of the piston crown portion 9, thus two sets (four×2=eight locations) in total. The oil return holes 34 each have open ends at the bottom of the oil ring groove 33*a* and an inner peripheral region of the piston crown portion 9, for fluid communication in between.

Here, the term 'thrust side' means one side portion of the piston 7 to be forced in a stroke descending in the cylinder bore 6 from the top dead center, to have forces due to rotating torque of the crankshaft 5, acting in a thrust direction perpendicular to an axial direction of the crankshaft 5, on an associated one-side region of the wall 6*a* of the cylinder bore 6.

Further, the term 'counter thrust side' means an opposite side portion of the piston 7 to be forced in a stroke ascending in the cylinder bore 6 toward the top dead center, to have forces due to rotating torque of the crankshaft 5, acting in a thrust direction opposite to the above thrust direction, on an associated opposite-side region of the wall 6*a* of the cylinder bore 6.

As will be seen from FIG. 1, each cylinder bore 6 has a spatial region defined by and between the wall 6*a* and an associated piston 7, where oil is supplied from an oil jet hole 8*a* provided through a large diameter portion 8B of an associated connecting rod 8. By doing so, as illustrated in FIG. 2 or 6, the cylinder bore 6 has a film 35 of oil formed over a whole circumference of the wall 6*a* for outer peripheral regions of the piston 7 (specifically, the piston crown portion 9) to be brought into contact thereon.

Such supply of oil serves for cooling the piston 7, as well as for lubrication between outer peripheral regions of the piston 7 and the wall 6*a* of the cylinder bore 6. It is noted that there may well be elements else than oil jet holes 8*a*, employed for such oil introduction.

The engine 1 includes a non-depicted oil pan provided at a lower portion of the crankcase 2, the oil pan communicating with each cylinder bore 6. As an associated piston 7 vertically reciprocates in the cylinder bore 6, the oil ring fit in the oil ring groove 33 of the piston 7 scrapes oil adhering on the wall 6*a* of the cylinder bore 6. There can be fluxes of scraped oil conducted through oil return holes 34 at the bottom of the oil ring groove 33, and discharged onto inner peripheral regions at the piston crown portion 9 of the piston 7, to return to the oil pan through spatial regions between the front and rear skirt portions 11 and 10 of the piston 7.

As will be seen from FIGS. 2 and 6, at the aforementioned specific piston 7, the front and rear skirt portions 11 and 10 are adapted, when the piston 7 reciprocates, to come into contact at the thrust side or the counter thrust side with an associated region on the wall 6*a* the cylinder bore 6, thereby exhibiting a function of suppressing swing motions of the piston 7.

As illustrated in FIG. 3, at the above-noted piston 7, the rear skirt portion 10 is formed substantially in a rectangular shape (specifically, a rectangular oblong shape) in a rear view of the piston 7, having a combination of two narrow sides extending in parallel with the central axis C of the piston crown portion 9 and two long sides extending in parallel with a perpendicular direction (e.g., an extending direction of the axis C1 of the piston pin 16) to the central axis C of the piston crown portion 9.

Also the front skirt portion 11 of the piston 7 is formed substantially in a rectangular shape (specifically, a rectangular oblong shape) in a front view of the piston 7, having a combination of two narrow sides and two long sides, like the rear skirt portion 10.

Figure 8:
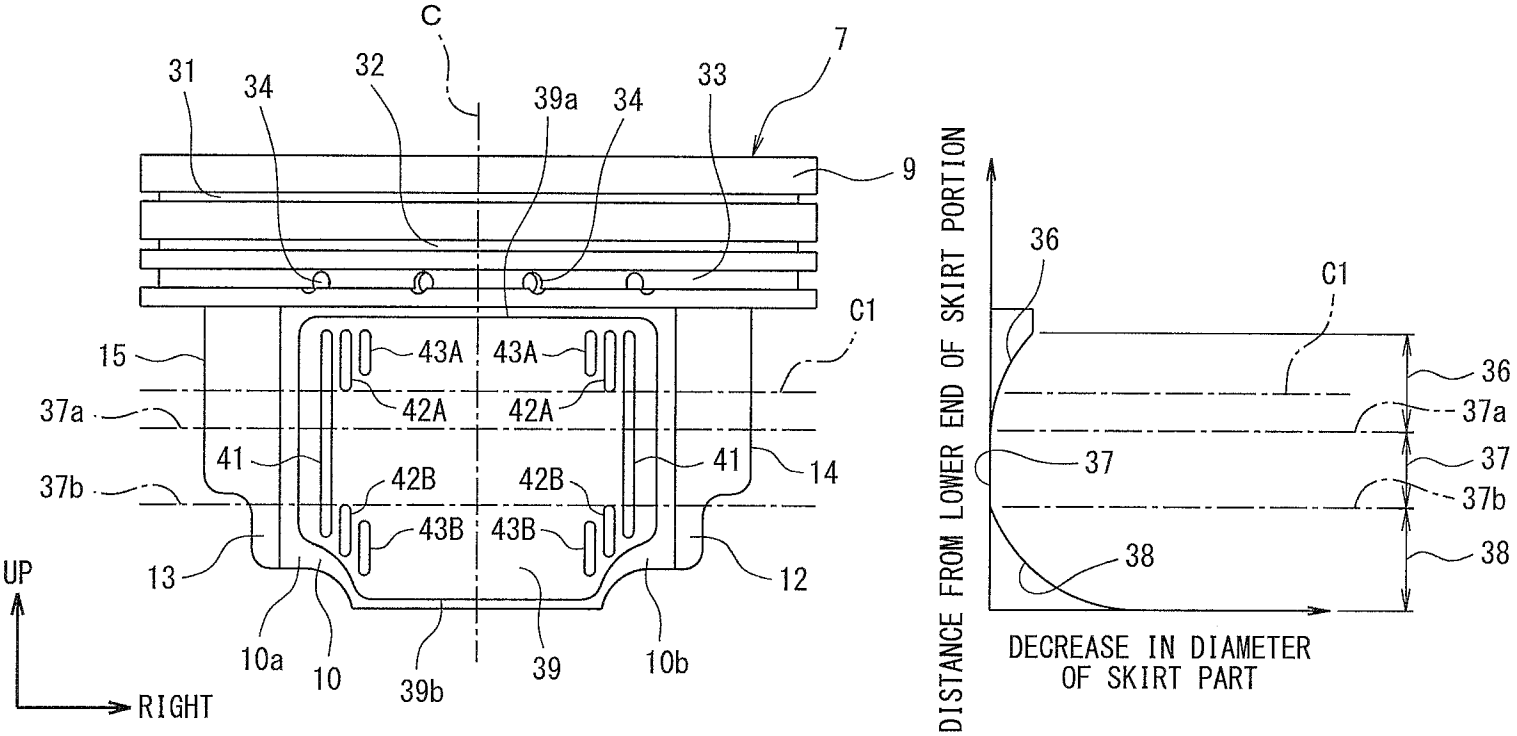
FIG. 8 is a diagram illustrating a set of positional relations between a rear side of the piston and curvatures along a curved outer peripheral surface of the skirt portion in an axial direction of the piston (i.e., variations of curvature in the vertical direction), as a figure showing a piston for internal combustion engines according to the embodiment of this invention.

As shown in FIG. 6 or 8, at the piston 7, the front and rear skirt portions 11 and 10 have front and rear central skirt parts 37 and 37 as their central parts with respect to an extending direction of the central axis C (i.e., an axial direction) of the piston crown portion 9. The central skirt parts 37 and 37 constitute a maximal outside diameter portion (as a combination of maximal radius parts) of the front and rear skirt portions 11 and 10. In a side view of the piston 7, as shown at the right half of FIG. 8 or 10, each central skirt part 37 has an outer circumferential surface thereof (arcuate in a plan view) constituting a circumferential surface of a straight cylindrical shape having an axis in parallel with the central axis C of the piston crown portion 9. Here, the central axis C of the piston crown portion 9 overlaps a line of symmetry of the front and rear skirt portions 11 and 10 (that is, they reside on an identical straight line.)

Further, at the piston 7, the front and rear skirt portions 11 and 10 have upper skirt parts 36 and 36 thereof residing at upper levels than an upper boundary (specifically, an imaginary upper boundary plane) 37*a* of the central skirt parts 37 and 37, respectively. As shown at the right half of FIG. 8, those upper skirt parts 36 and 36 each have an outer peripheral surface thereof formed, in the side view of the piston 7, in the shape of a half arc segment of an inverted bowl. In the side view of the piston 7, this bowl shape is curved with an outside diameter or radius gradually decreased from a maximal outside diameter or maximum radius (which is equal to an outside diameter or radius at the upper boundary 37*a* of an associated central skirt part 37), toward the central axis C of the piston crown portion 9, as it extends upward from the upper boundary 37*a*.

It is noted that, in the side view of the piston 7, the upper boundary 37*a* of the central skirt parts 37 and 37 is located at a lower level than the central axis C1 of the piston pin 16 with respect to an extending direction of the central axis C (i.e., in an axial direction) of the piston crown portion 9.

Further, at the piston 7, the front and rear skirt portions 11 and 10 have lower skirt parts 38 and 38 thereof residing at lower levels than a lower boundary (specifically, an imaginary lower boundary plane) 37*b* of the central skirt parts 37 and 37, respectively. As shown at the right half of FIG. 8, those lower skirt parts 38 and 38 each have an outer peripheral surface thereof formed, in the side view of the piston 7, in the shape of a half arc segment of a normally put bowl. In the side view of the piston 7, this bowl shape is curved with an outside diameter or radius gradually decreased from a maximal outside diameter or maximum radius (which is equal to an outside diameter or radius at the upper boundary 37*a* of an associated central skirt part 37), toward the central axis C of the piston crown portion 9, as it extends downward from the lower boundary 37*b*.

As will be seen from above, the graph at the right side of FIG. 8 (as well as a graph at the right side of FIG. 10) shows a profile (specifically, a right side view) of a barrel shape (specifically, a rear one of front and rear divided barrel shapes mutually line-symmetrical with respect to the central axis C of the piston crown portion 9) defined by a combination of six skirt parts being:

the upper skirt parts 36 and 36:
the central skirt parts 37 and 37; and
the lower skirt parts 38 and 38.

In this graph, the horizontal axis represents a decrease in diameter of the barrel shape (specifically, each of the upper and lower skirt parts 36, 36 and 38, 38) relative to an associated central skirt part 37, and the vertical axis represents a vertical distance from a lower bottom of the barrel shape (specifically, from a lower end of an associated one of the front and rear skirt portions 11 and 10).

Such being the case, at the piston 7, the front and rear skirt portions 11 and 10 constitute a barrel shaped portion.

It is noted that, in FIG. 6, the front and rear skirt portions 11 and 10 of the piston 7 are depicted to be significantly curved for the convenience of description, while actually they are not so significantly curved.

As shown in FIG. 5 being a bottom view of the piston 7, the front and rear skirt portions 11 and 10 have gradually increased curvatures at their upper skirt parts 36 and 36, central skirt parts 37 and 37, and lower skirt parts 38 and 38, as the front and rear skirt portions 11 and 10 extend from circumferential central regions 11*c* and 10*c* thereon, in both circumferential directions (i.e., as they approach the left and right side parts 11*a* and 11*b* of the front skirt portion 11 or the left and right side parts 10*a* and 10*b* of the rear skirt portion 10 that are connected to the front left and front right side wall portions 13 and 12 or the rear left and rear right side wall portions 13 and 12, respectively). Accordingly, as shown in FIG. 5, the front and rear skirt portions 11 and 10 have curved outer peripheral surfaces thereof gradually spaced apart from the wall 6*a* of the cylinder bore 6, with gradually increased clearances in between.

At the front and rear skirt portions 11 and 10, the circumferential central regions 11*c* and 10*c* constitute apexes on circumferences (e.g., narrow local regions each extending along a radially most bulged outside-line of a profile of the barrel shape in FIG. 8) of the front and rear skirt portions 11 and 10 interconnecting front or rear end part of the left side wall portion 13 and front or rear end part of the right side wall portion 12 with each other, respectively. Accordingly, on the barrel shape being a combination of the front and rear skirt portions 11 and 10, its outer periphery has a smallest clearance at the circumferential central regions 11*c* and 10*c* relative to the wall 6*a* of the cylinder bore 6, as it extends in a circumferential direction.

As will be seen from FIGS. 2 to 5, the front and rear skirt portions 11 and 10 have front and rear resin coat films 39 and 39 formed over surface regions (excluding outside edges) of outer peripheries thereof, with a prescribed thickness, by using a screen method, for example. Those resin coat films 39 and 39 have low friction resistances and high heat resistances.

The front and rear resin coat films 39 and 39 circumferentially extend with respect to the barrel shape, covering respective outer peripheries of the upper skirt parts 36 and 36, the central skirt parts 37 and 37, and the lower skirt parts 38 and 38 of the front and rear skirt portions 11 and 10 opposing the wall 6*a* of the cylinder bore 6.

For instance, as shown in the left half of FIG. 8, the rear resin coat film 39 (as well as the front resin coat film 39) has an upper end 39*a* as an upper edge thereof extending alongside an upper edge of the rear skirt portion 10, and a lower end 39*b* as a lower edge thereof extending alongside a lower edge of the rear skirt portion 10.

Further, as shown in the left half of FIG. 8, the rear resin coat film 39 (as well as the front resin coat film 39) has a left end as a left edge thereof extending alongside a left edge of the left side part 10*a* of the rear skirt portion 10, and a right end as a right edge thereof extending alongside a right edge of the right side part 10*b* of the rear skirt portion 10.

Figure 7:
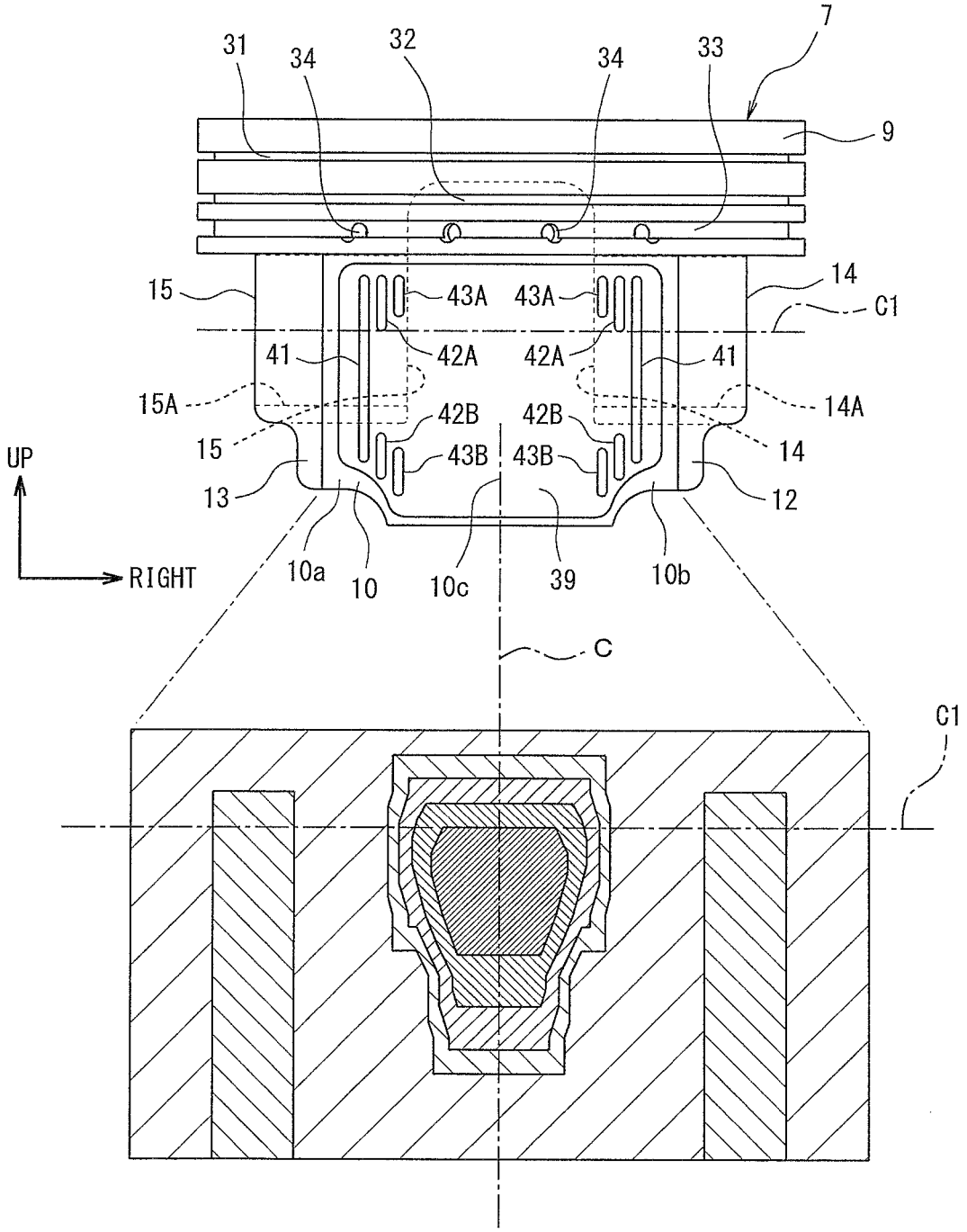
FIG. 7 is a distribution pattern diagram illustrating a set of positional relations between a rear side of the piston and contact pressures to be exerted on a skirt portion of the piston, as a figure showing a piston for internal combustion engines according to the embodiment of this invention.

As shown in FIG. 2, 3, 4, 7, or 8 (in particular, as best shown in FIG. 7), the rear resin coat film 39 (as well as the front resin coat film 39) is knurled at an outer peripheral surface thereof with a left set of five vertical grooves including:

- a left long vertical groove 41 nearest to the left edge of the rear resin coat film 39 (hence, nearest to the left edge of the rear skirt portion 10);
- an upper pair of short left vertical grooves 42A and 43A neighboring an upper part of the left long vertical groove 41 in a circumferential direction of the rear resin coat film 39 (hence, in a circumferential direction of the rear skirt portion 10); and
- a lower pair of short left vertical grooves 42B and 43B neighboring a lower part of the left long vertical groove 41 in a circumferential direction of the rear resin coat film 39.

Further, the rear resin coat film 39 (as well as the front resin coat film 39) is knurled at the outer peripheral surface thereof with a right set of five vertical grooves including:

- a right long vertical groove 41 nearest to the right edge of the rear resin coat film 39 (hence, nearest to the right edge of the rear skirt portion 10);
- an upper pair of short right vertical grooves 42A and 43A neighboring an upper part of the right long vertical groove 41 in a circumferential direction of the rear resin coat film 39 (hence, in a circumferential direction of the rear skirt portion 10); and
- a lower pair of short right vertical grooves 42B and 43B neighboring a lower part of the right long vertical groove 41 in a circumferential direction of the rear resin coat film 39.

The left five vertical grooves 41, 42A, 42B, 43A and 43B and the right five vertical grooves 41, 42A, 42B, 43A and 43B are each oriented to extend in parallel with the central axis C of the piston crown portion 9, and are located within ranges in which the left or right piston pin boss portion 15 or 14 extends, with respect to (vehicle-transverse) directions perpendicular to the central axis C of the piston crown portion 9 in a rear view of the piston 7 (e.g., in the upper half of FIG. 7).

In other words, the left and right sets of vertical grooves 41, 42A, 42B, 43A and 43B are disposed within left and right circumferential surface regions of the resin coat film 39 that vertically overlap the left or right piston pin boss portion 15 or 14 (defined in part by broken lines) in FIG. 7.

As will be seen from FIGS. 3 to 5 and FIG. 7, at the rear resin coat film 39 (or the front resin coat film 39, vice versa), the left and right sets of vertical grooves 41, 42A, 42B, 43A and 43B involve:

- 'a combination of left upper and lower vertical grooves 43A and 43B and right upper and lower vertical grooves 43A and 43B nearest to the circumferential central region 10*c* (or 11*c*) of the rear skirt portion 10 (or the front skirt portion 11)', as a combination of shortest ones; and
- 'a combination of left and right vertical grooves 41 and 41 nearest to the left or right side wall portion 13 or 12 at the rear side (or the front side) of the piston 7', as a combination of longest ones.

Further, at the rear resin coat film 39 (or the front resin coat film 39), the left and right sets of vertical grooves each involve a combination of upper and lower intermediate vertical grooves 42A and 42B interposed between an associated outermost vertical groove 41 and an associated combination of innermost upper and lower vertical grooves 43A and 43B, the intermediate vertical grooves 42A and 42B having a length thereof shorter than the outermost vertical groove 41, and longer than each of the innermost vertical grooves 43A and 43B.

As shown in FIG. 7, at the rear resin coat film 39 (or the front resin coat film 39), those upper and lower vertical grooves 42A and 42B, and 43A and 43B which are paired at the left side, and those upper and lower vertical grooves 42A and 42B, and 43A and 43B which are paired at the right side are formed in those upper and lower regions on the outer peripheral surface of the resin coat film 39 which correspond to, that is, overlap the upper skirt part 36 and the lower skirt part 38 of the rear skirt portion 10 (or the front skirt portion 11) in a rear view of the piston 7, respectively.

Therefore, the paired upper and lower vertical grooves 42A and 42B, and 43A and 43B are not formed any in that region on the outer peripheral surface of the resin coat film 39, which corresponds to the central skirt part 37 of the rear skirt portion 10 (or the front skirt portion 11).

It is noted that there is no vertical groove formed in 'a central zone' of the outer peripheral surface of the resin coat film 39 that vertically extends at both sides of, and inclusive of, the circumferential central region 10*c* (or 11*c*) of the rear skirt portion 10 (or the front skirt portion 11), between the left pair of upper and lower innermost vertical grooves 43A and 43B and the right pair of upper and lower innermost vertical grooves 43A and 43B, which overlap axially inner ends of the left and right piston pin boss portions 15 and 14, respectively, in the rear view of the piston 7.

As shown in the left half of FIG. 8 being a rear view of the piston 7, at the rear resin coat film 39 (or the front resin coat film 39), the left upper vertical grooves 42A and 43A as well as the right upper vertical grooves 42A and 43A are disposed to extend vertically in the figure (i.e., in parallel with the central axis C of the piston crown portion 9), in a region on the upper skirt part 36 of the rear skirt portion 10 (or the front skirt portion 11), specifically between the upper end 39*a* of the resin coat film 39 and the upper boundary 37*a* of the central skirt part 37 of the rear skirt portion 10 (or the front skirt portion 11), more specifically, between the upper end 39*a* of the resin coat film 39 and the central axis C1 of the piston pin 16 (see FIG. 1).

Further, as shown in the left half of FIG. 8, at the rear resin coat film 39 (or the front resin coat film 39), the left lower vertical grooves 42A and 43A as well as the right lower vertical grooves 42A and 43A are disposed to extend vertically in the figure, in a region on the lower skirt part 38 of the rear skirt portion 10 (or the front skirt portion 11), specifically between the lower end 39*b* of the resin coat film 39 and the lower boundary 37*b* of the central skirt part 37 of the rear skirt portion 10 (or the front skirt portion 11).

Further, in the left half of FIG. 8, the upper left and right vertical grooves 42A and 42A of an intermediate length have lower ends thereof in contact with the upper boundary 37*a* of the central skirt part 37, and the lower left and right vertical grooves 42B and 42B of an intermediate length have upper ends thereof in contact with the lower boundary 37*b* of the central skirt part 37. On the other hand, the upper left and right vertical grooves 43A and 43A of a shortest length have lower ends thereof spaced upward from the upper boundary 37*a* of the central skirt part 37, and the lower left and right vertical grooves 43B and 43B of a shortest length have upper ends thereof spaced downward from the lower boundary 37*b* of the central skirt part 37. And, the left and right vertical grooves of a greatest length are disposed to extend vertically in the figure, over a range involving the upper skirt part 36, the central skirt part 37, and the lower skirt part 38 of the rear skirt portion 10 (or the front skirt portion 11).

Figure 9:
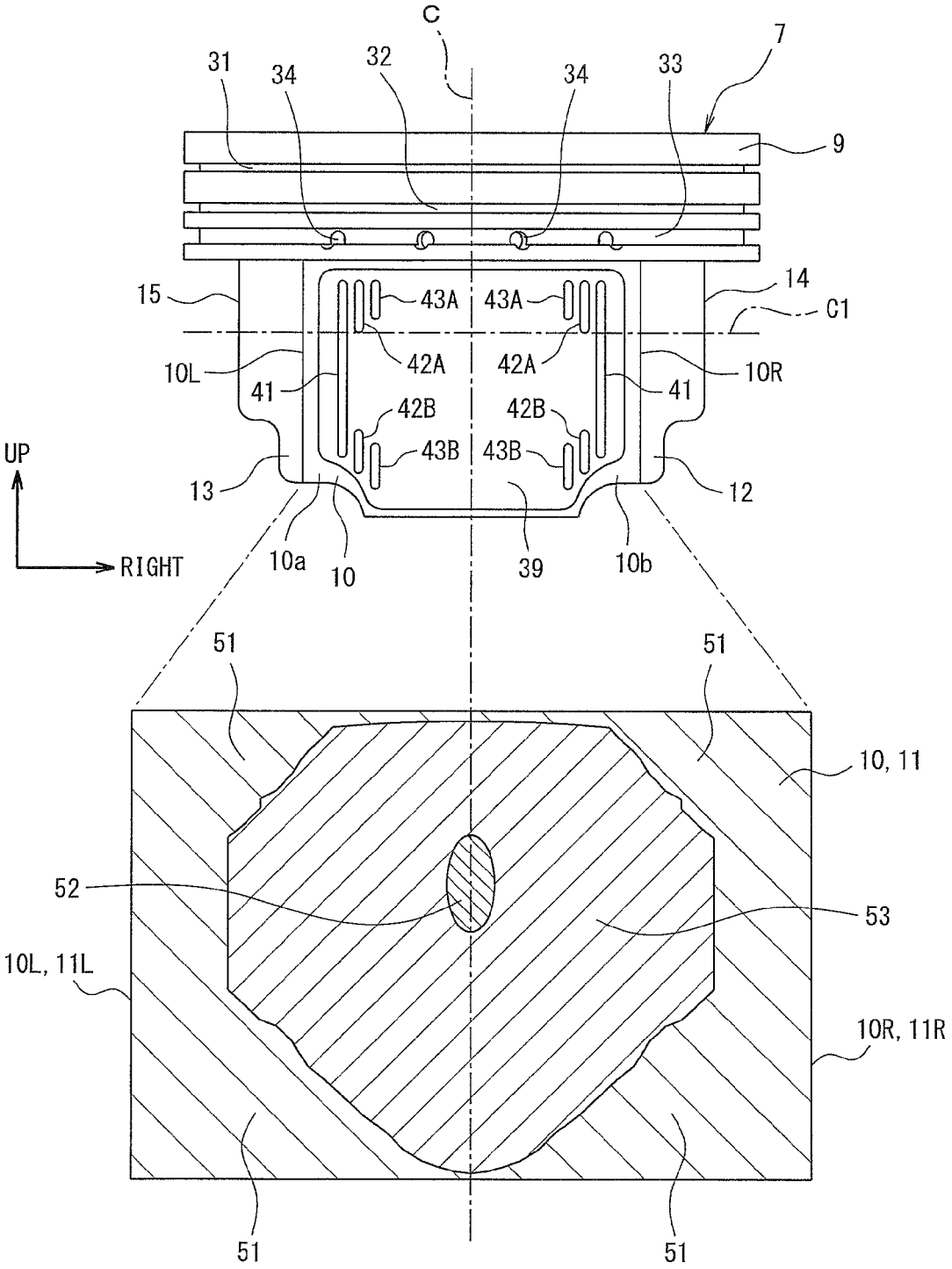
FIG. 9 is a distribution pattern diagram commonly illustrating a set of positional relations between a rear side of the piston and clearances that each of front and rear skirt portions of the piston has to a wall of the cylinder bore, as a figure showing a piston for internal combustion engines according to the embodiment of this invention.

FIG. 9 commonly shows, in an expanded map in the lower half, a distribution pattern of clearances that the rear skirt portion 10 and the front skirt portion 11 have at their outer peripheries to the wall 6*a* of the cylinder bore 6. It is noted that the map in FIG. 9 is prepared as an overlapping rear view of the front and rear skirt portions 11 and 10 from the driver's seat. In this map, the front skirt portion 11 has left and right edges thereof mapped as end parts 11L and 11R overlapping left and right edges mapped as end parts 10L and 10R of the rear skirt portion 10, respectively.

As shown in FIG. 9, at the rear skirt portion 10 (or the front skirt portion 11), the outer periphery is formed in a four-sided shape in a rear view of the piston 7, defined by the upper and lower edges of the skirt portion 10 (or 11) as long sides, and the left and right edges 10L and 10R (or 11L and 11R) of the skirt portion 10 (or 11) as narrow sides.

The rear skirt portion 10 (or the front skirt portion 11) constituting the barrel shape has most increased clearances to the wall 6*a* of the cylinder bore 6 in regions at four corners being upper and lower left and right corners of the four-sided outer periphery, and most decreased clearances to the wall 6*a* of the cylinder bore 6 in a transversely and vertically central region of the outer periphery. In the map of FIG. 9, the hatching denotes smaller clearances, as it has shorter intervals.

At the rear skirt portion 10 (or the front skirt portion 11), the outer periphery has, at intermediate regions between the central region and the regions at the four corners, such intermediate clearances to the wall 6*a* of the cylinder bore 6 that are smaller than at the regions at the four corners, and larger than at the central region.

In the map of FIG. 9, the outer periphery of the rear skirt portion 10 (or the front skirt portion 11) includes a large clearance region 51 defined by a connected region of the regions at the four corners, a small clearance region 52 defined by the central region, and an intermediate clearance region 53 defined by a connected region of the intermediate regions, that is, a region between the large clearance region 51 and the small clearance region 52.

In a rear view of the piston 7 shown in the upper half of FIG. 9, the small clearance region 52 shown in the map in the lower half of FIG. 9 resides in a vicinity of a point of intersection between the central axis C of the piston crown portion 9 and the central axis C of the piston pin 16. The small clearance region 52 has a vertically elongate small elliptical shape.

In the rear view of the piston 7, the intermediate clearance region 53 has a seven-sided shape vehicle-transversely line-symmetrical with respect to the central axis C of the piston crown portion 9. The seven-sided shape includes:

- a top side vehicle-transversely extending alongside the upper edge 39*a* (see FIG. 8) of the rear resin coat film 39 (or the front resin coat film 39);
- a left vertical side vehicle-vertically extending in parallel with the left edge 10L (or 11L) of the rear skirt portion 10 (or the front skirt portion 11);
- a right vertical side vehicle-vertically extending in parallel with the right edge 10R (or 11R) of the rear skirt portion 10 (or the front skirt portion 11);
- a left upper oblique side interconnecting a left end of the top side and an upper end of the left vertical side;
- a right upper oblique side interconnecting a right end of the top side and an upper end of the right vertical side;
- a bottom apex located in a vicinity of a point of intersection between the central axis C of the piston crown portion 9 and the lower edge 39*b* (see FIG. 8) of the rear resin coat film 39 (or the front resin coat film 39);
- a left lower oblique side interconnecting the bottom apex and a lower end of the left vertical side; and
- a right lower oblique side interconnecting the bottom apex and a lower end of the right vertical side.

The large clearance region 51 is defined by an entire region in the four-sided shape on the outer periphery of the rear resin coat film 39 (or the front resin coat film 39), as a combination of the small clearance region 52 and the intermediate clearance region 53 is cut out, and involves upper and lower combinations of left and right sub-regions corresponding to the regions at the four corners, the sub-regions having substantially tri-angular shapes.

Figure 11:
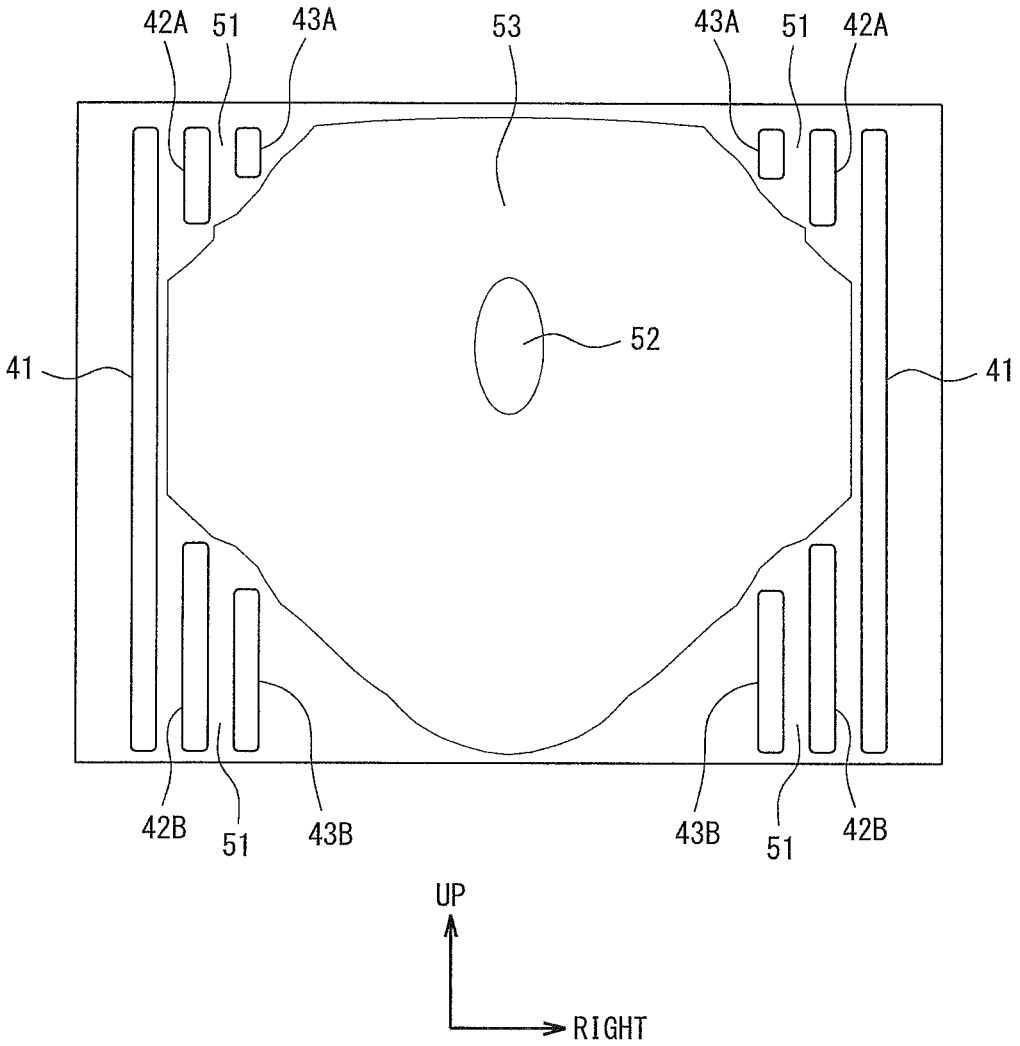
FIG. 11 is a diagram commonly illustrating a distribution pattern of clearances that each of front and rear skirt portions of the piston has to the wall of the cylinder bore, as it is overlapped on a distribution pattern of vertical grooves formed in a resin coat film layer of that skirt portion, as a figure showing a piston for internal combustion engines according to the embodiment of this invention.

As shown in FIG. 11, according to embodiments herein, the rear resin coat film 39 (or the front resin coat film 39) has the left and right sets of five vertical grooves 41, 42A, 42B, 43A, and 43B knurled in a region on the outer periphery of the resin coat film 39 corresponding to (i.e., overlapping in a rear view of the piston 7) the large clearance region 51 of the rear skirt portion 10 (or the front skirt portion 11).

Figure 10:
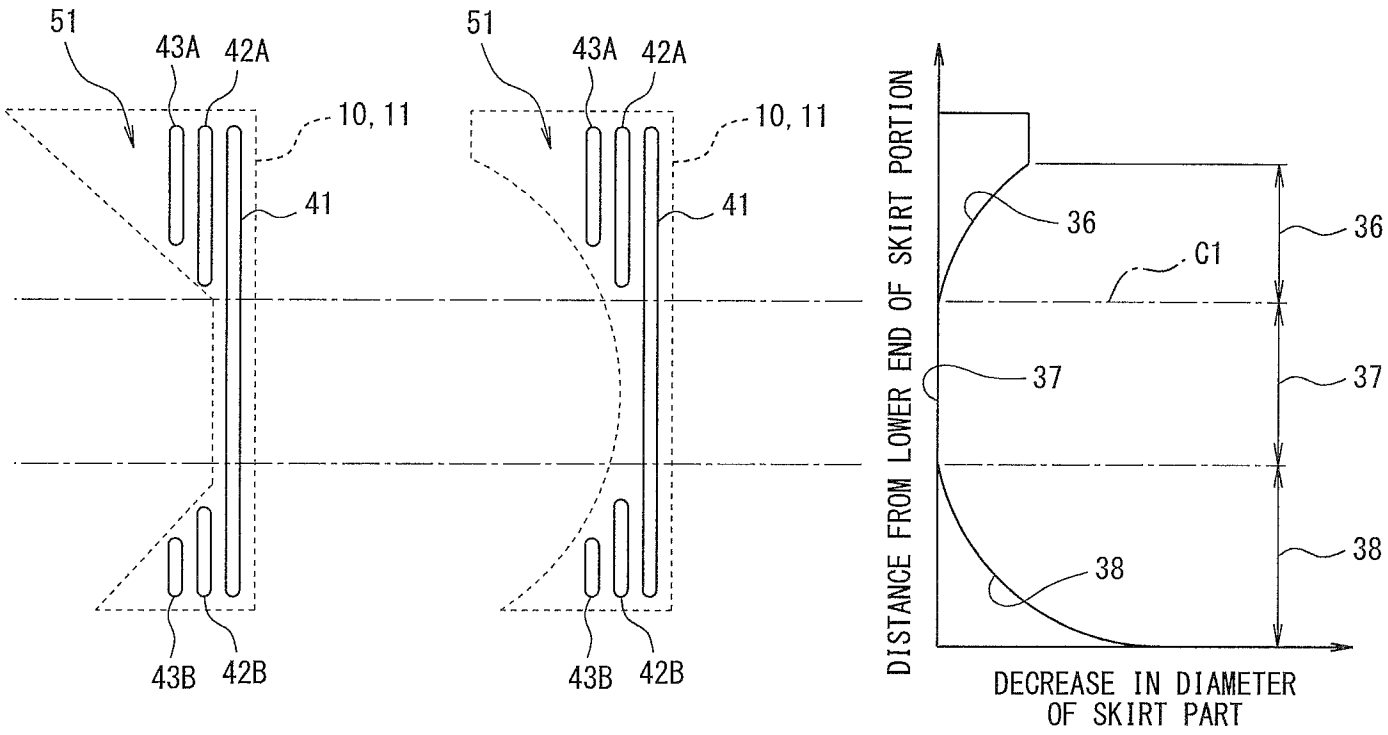
FIG. 10 is a distribution pattern diagram commonly illustrating, for each of front and rear skirt portions of the piston, two different sets of positional relations between a curved outer peripheral surface thereof and vertical grooves formed in a resin coat film layer thereon, as a figure showing a piston for internal combustion engines according to the embodiment of this invention.

FIG. 10 shows, at a leftmost diagram therein, positional relations between the right set of five vertical grooves 41, 42A, 42B, 43A, and 43B and a right half region of the large clearance region defined by the seven-sided intermediate clearance region 53 (see FIG. 9) of the rear skirt portion 10 (or the front skirt portion 11), in comparison with a combination of a rightmost diagram therein (identical to the profile at the right half of FIG. 8) illustrating variations in curvature of along the outer periphery of the rear skirt portion 10 (or the front skirt portion 11), and a central diagram therein illustrating an example including a large clearance region 51 defined by a circular arcuate boundary, while connecting those diagrams by extending the upper and lower boundaries 37*a* and 37*b* (see FIG. 8) of the skirt part 37 at the rear skirt portion 10 (or the front skirt portion 11).

As will be seen from FIG. 10, among the set of five vertical grooves at each of the left and right sides, the shortest upper and lower vertical grooves 43A and 43B are knurled at those local regions in vicinities of central parts at the oblique sides of the seven-sided shape in the large clearance region 51 of the rear skirt portion 10 (or the front skirt portion 11), which correspond to outer peripheral regions of the upper and lower skirt parts 36 and 28 spaced circumferentially leftward or rightward off from the circumferential central region 10*c* (or 11*c*, see FIG. 5) of the skirt portion 10 (or 11), subject to clearances to the wall 6*a* of the cylinder bore 6 to be minimized when the piston 7 operates.

As will be seen from FIG. 10, among the set of five vertical grooves at each of the left and right sides, the longest vertical groove 41 is knurled at that local region alongside the left or right narrow side of the four-sided large clearance region 51 of the rear skirt portion 10 (or the front skirt portion 11), which corresponds to an outer peripheral region of the skirt portion 10 (or 11) residing nearest to the left or right side wall portion 13 or 12, subject to clearances to the wall 6*a* of the cylinder bore 6 to be maximized when the piston 7 operates.

The front and rear resin coat films 39 and 39 are each formed by applying a paint coating including PAI (polyamide imide) and molybdenum di-sulphide as principal ingredients, on the rear skirt portion 10 (or the front skirt portion 11), by using a screen printer, for instance, while implementing, on the skirt portion 10 (or 11), a masking process of using sets of masks identical in shape to respective vertical grooves 41, 42A, 42B, 43A, and 43B, to provide on an outer peripheral surface of the skirt portion 10 (or 11), sets of vertical grooves 41, 42A, 42B, 43A, and 43B knurled with depths within a range of 5 μm or more and 20 μm or less, or with a depth of 10 μm equal to a thickness of the resin coat film 39.

Description is now made of friction forces to be developed between the piston 7 and the wall 6*a* of the cylinder bore 6.

When reciprocating in the cylinder bore 6, the piston 7 has part of combustion pressures imposed thereon through an associated connecting rod 8 (see FIG. 1) and the piston pin 16.

By such combustion pressures, the front and rear skirt portions 11 and 10 are brought into contact with the wall 6*a* of the cylinder bore 6, when the left and right piston pin boss portions 15 and 14 have local parts thereof contacting with local parts of the piston pin 16, which serve as input points of pressing forces acting to press the skirt portions 11 and 10 against the wall 6*a* of the cylinder bore 6.

The piston 7 does reciprocate, undergoing frictional forces produced between the front and rear skirt portions 11 and 10 and the wall 6*a* of the cylinder bore 6, due to reciprocation of the skirt portions 11 and 10 on the wall 6*a* of the cylinder bore 6, under exertion of pressing forces attributable to combustion pressures.

FIG. 7 illustrates, in an expanded map at the lower half, a distribution pattern of contact pressures to be produced between the rear skirt portion 10 (or the front skirt portion 11) and the wall 6*a* of the cylinder bore 6. It is noted that, in the map of FIG. 7, the hatching denotes smaller contact pressures, as it has shorter intervals.

According to embodiments herein, at the piston 7, the left and right piston pin boss portions 15 and 14 have local parts thereof contacting local parts of the piston pin 16, serving as input points of pressing forces acting to press the front and rear skirt portions 11 and 10 against the wall 6*a* of the cylinder bore 6. Therefore, the rear skirt portion 10 (or the front skirt portion 11) is cooperative with the wall 6*a* of the cylinder bore 6, to have increased contact pressures in between, at outer peripheral regions of the skirt portion 10 (or 11) corresponding to (i.e., overlapping in a rear view of the piston 7 shown at, e.g., the upper half of FIG. 7) the left and right piston pin boss portions 15 and 14 or imaginary extensions thereof.

As shown in FIG. 7, the rear skirt portion 10 (or the front skirt portion 11) is cooperative with the wall 6*a* of the cylinder bore 6, to have contact pressures in between:

increased to be larger than surrounding regions, at local regions (i.e., left and right columnar regions in the map of FIG. 7) on the outer periphery of the skirt portion 10 (or 11), corresponding to axially central parts of the left and right piston pin boss portions 15 and 14; and increased stepwise to be equal to or larger than the local regions, at a central zone vehicle-vertically extending including the circumferential central region 10*c* (or 11*c*, see FIG. 5) at the outer periphery of the skirt portion 10 (or 11), getting maximized in a vicinity of a length of the central axis C of the piston crown portion 9 extending downward of the central axis C1 of the piston pin 16.

According to embodiments herein, as described, the front and rear skirt portions 11 and 10 are formed in a barrel shape (see FIG. 6) having circumferential central regions 11*c* and 10*c* of the skirt portions 11 and 10 protruding forward (i.e., constituting apexes) with respect to a vehicle-longitudinal direction perpendicular to the central axis C1 of the piston pin 16 in a rear view of the piston 7. Further, at the front and rear skirt portions 11 and 10, their outer peripheral surfaces have increased curvatures (see FIG. 5), as they extend from the circumferential central regions 11*c* and 10*c*, circumferentially approaching the left and right side wall portions 13 and 12.

By doing so, at the front and rear skirt portions 11 and 10, the central skirt parts 37 have most decreased clearances to the wall 6*a* of the cylinder bore 6, so there can be most increased contact pressures between the wall 6*a* o the cylinder bore 6 and the circumferential central regions 11*c* and 10*c* of the skirt portions 11 and 10 with respect to the vehicle-longitudinal direction perpendicular to the central axis C1 of the piston pin 16 in the rear view of the piston 7.

Accordingly, at the piston 7, there can be local parts undergoing decreased clearances between the front and rear skirt portions 11 and 10 and the wall 6*a* of the cylinder bore 6 and increased contact pressures between the skirt portions 11 and 10 and the wall 6*a* of the cylinder bore 6, requiring conditions for lubrication to be severer than conditions for lubrication at local parts undergoing increased clearances between the front and rear skirt portions 11 and 10 and the wall 6*a* of the cylinder bore 6 and decreased contact pressures between the skirt portions 11 and 10 and the wall 6*a* of the cylinder bore 6.

According to embodiments herein, the piston 7 is adapted for a preferable lubrication to be performed under such severe conditions for lubrication. Description will be made of a specific method of lubricating the piston 7.

It is noted that, at the piston 7, the front and rear skirt portions 11 and 10 are identical in configuration and performance, and description is to be made of the rear skirt portion 10. Further, with respect to moving directions of the piston 7, 'ahead or forward' and 'behind or backward' thereof will be referred to sometimes as 'downstream' and 'upstream', respectively.

According to embodiments herein, at the piston 7, the front and rear skirt portions 11 and 10 each have left and right sets of five vertical grooves 41, 42A, 42B, 43A, and 43B disposed in a large clearance region 51 thereof, thereby permitting much oil to be taken in between the wall 6*a* of the cylinder bore 6 and large clearance regions 51 of the skirt portions 11 and 10, when the piston 7 reciprocates.

Figure 12:
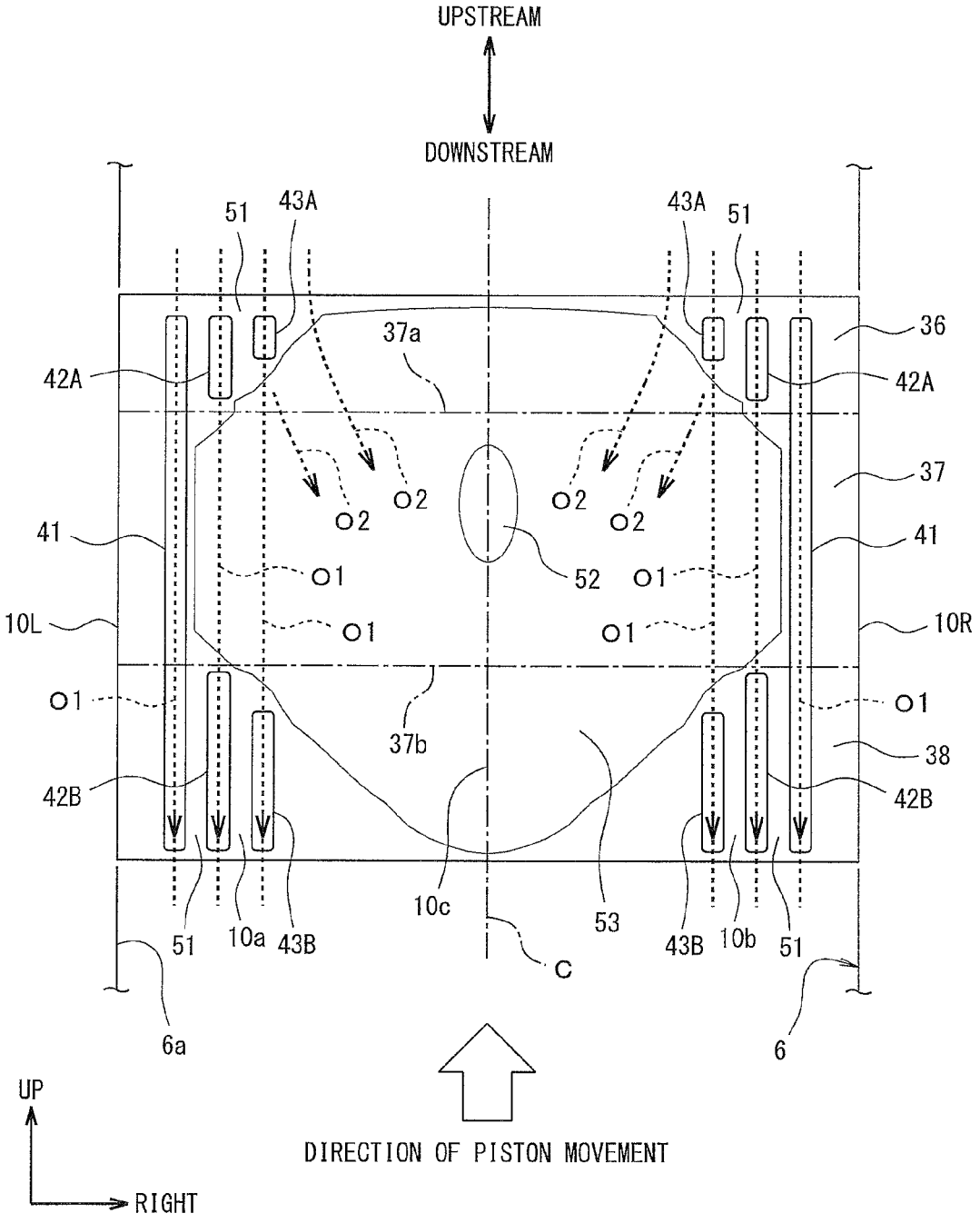
FIG. 12 is a diagram illustrating streams of oil on the piston in an ascending state, as they are overlapped on the distribution patterns in FIG. 11, as a figure showing a piston for internal combustion engines according to the embodiment of this invention.

As shown in FIG. 12 illustrating a situation at the rear skirt portion 10, when moving upward, the piston 7 has fluxes of oil introduced from upstream, to clearances between the upper skirt part 36 and the wall 6*a* of the cylinder bore 6.

There can be fluxes of oil introduced to clearances between the upper skirt part 36 and the wall 6*a* of the cylinder bore 6, and partially introduced (as fluxes of oil 01 indicated by broken lines) to a combination of vertical grooves 42A of an intermediate length and shortest vertical grooves 43A residing in an upper combination of left and right sub-regions among upper and lower combinations of left and right substantially tri-angular sub-regions (see FIG. 9) of the large clearance region 51, corresponding in a rear view of the piston 7 to (i.e., overlapping in FIG. 7) the left and right piston pin boss portions 15 and 14 or imaginary axial extensions thereof.

There can be fluxes of oil 01 introduced to the upper combination of left and right vertical grooves 42A and 43A, and further introduced, passing the upper left and right oblique sides of the seven-sided shape, to the intermediate clearance region 53, and still conducted, passing through the upper boundary 37*a* of the central skirt part 37, and along the left and right vertical sides of the seven-sided shape, to go down in the intermediate clearance region 53.

In other words, there can be fluxes of oil 01 conducted, through the upper boundary 37*a* of the central skirt part 37, to a rectangular oblong-shaped sub-region of the intermediate clearance region 53 overlapping the central skirt part 37, within a range of surface region at the outer periphery of the skirt portion 10 that overlaps extending directions of the left and right piston pin boss portions 15 and 14. The central skirt part 37 has a maximized diameter at a central region thereof with respect to an extending direction of the central axis C of the piston crown portion 9.

The skirt portion 10 has decreased clearances to the wall 6*a* of the cylinder bore 6, as it extends from the left part 10*a* or the right part 10*b* toward the circumferential central region 10*c*. Hence, there can be fluxes of oil (as oil 02 indicated by broken lines) introduced through the upper left or right innermost vertical groove 43A or 43A, or from over a sub-region of the large clearance region 51 residing still inside of the innermost vertical grooves 43A and 43A, and passing the upper left or right oblique side of the seven-sided shape, to the intermediate clearance region 53, and conducted toward the circumferential central region 10*c* of the skirt portion 10, to introduce to the small clearance region 52.

By doing so, at the skirt portion 10, there can be favorable lubrication implemented over a combination of the small clearance region 52 and the intermediate clearance region 53, as well as over associated regions on the wall 6*a* of the cylinder bore 6.

It is noted that there can be ample oil between the large clearance region 51 of the skirt portion 10 and the wall 6*a* of the cylinder bore 6, allowing for resistances to be generated by such oil, as necessary.

According to embodiments herein, there can be fluxes of oil 01 introduced to the large clearance region 51 of the skirt portion 10, and separated to conduct from any one of upstream vertical grooves (i.e., the upper left and right vertical grooves) 42A and 43A to an associated one of downstream grooves (i.e., the lower left and right vertical grooves) 42B and 43B, or directly from a region vicinal to the top side to a region vicinal to the bottom side of the four-sided shape by one of the outermost left and right longest vertical grooves 41. By doing so, there can be fluxes of excessive oil discharged downstream of the vertical groove 41, 42B, or 43B, smoothly and without stagnation, thus allowing for dragging resistances by oil to the piston 7 to be reduced.

Figure 13:
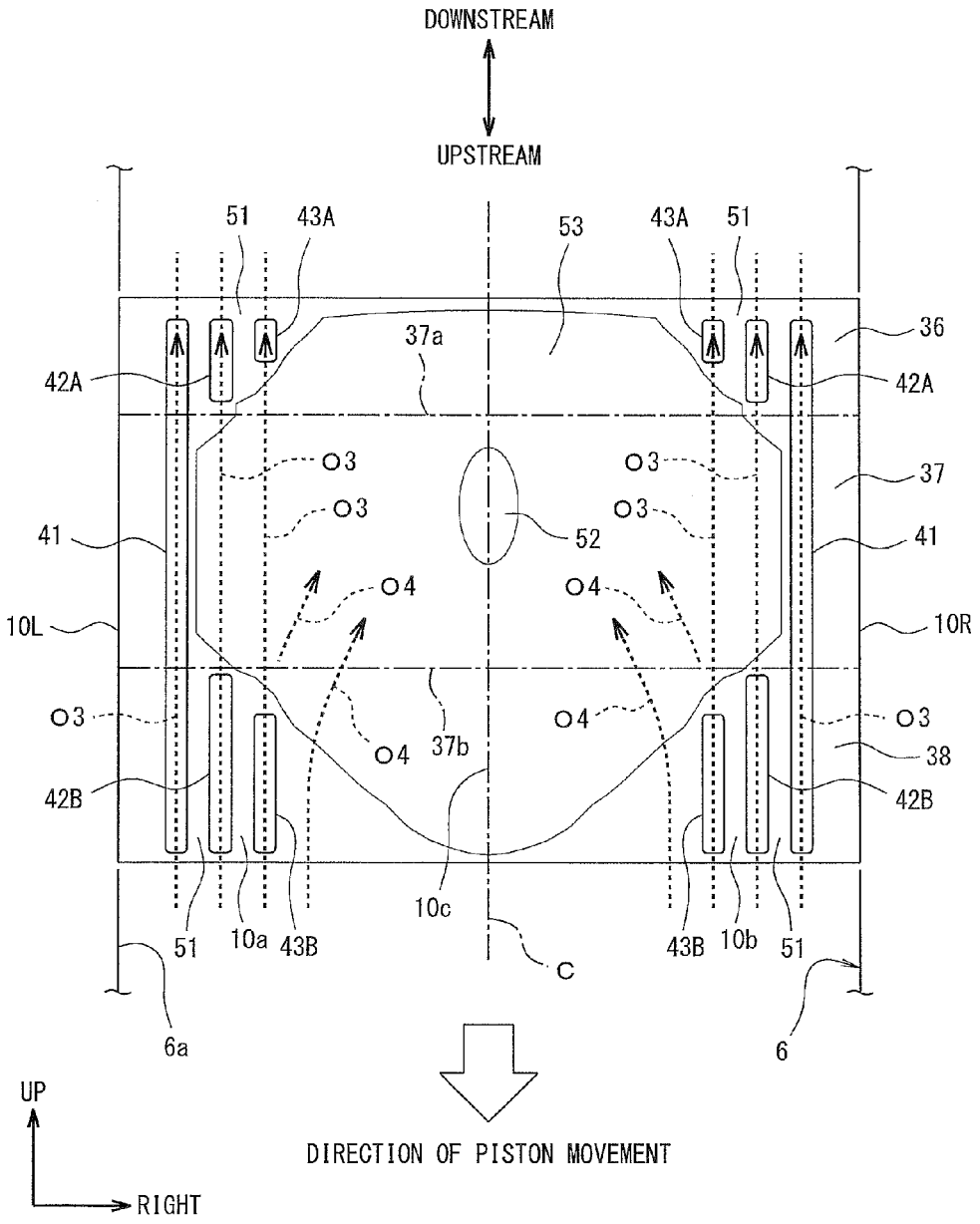
FIG. 13 is a diagram illustrating streams of oil on the piston in a descending state, as they are overlapped on the distribution patterns in FIG. 11, as a figure showing a piston for internal combustion engines according to the embodiment of this invention.

On the other hand, as shown in FIG. 13 illustrating a situation at the rear skirt portion 10, when moving downward, the piston 7 has fluxes of oil introduced from upstream, to clearances between the lower skirt part 38 and the wall 6*a* of the cylinder bore 6.

There can be fluxes of oil introduced to clearances between the lower skirt part 38 and the wall 6*a* of the cylinder bore 6, and partially introduced (as oil O3 indicated by broken lines) to a combination of vertical grooves 42B of an intermediate length and shortest vertical grooves 43B residing in an lower combination of left and right tri-angular sub-regions of the large clearance region 51, overlapping extending directions of the left and right piston pin boss portions 15 and 14.

There can be fluxes of oil O3 introduced to the lower combination of left and right vertical grooves 42B and 43B, and further introduced, passing the lower left and right oblique sides of the seven-sided shape, to the intermediate clearance region 53, and still conducted, passing through the lower boundary 37*b* of the central skirt part 37, and along the left and right vertical sides of the seven-sided shape, to go up in the intermediate clearance region 53.

In other words, there can be fluxes of oil O3 conducted, through the lower boundary 37*b* of the central skirt part 37, to the rectangular oblong-shaped sub-region of the intermediate clearance region 53, within the range of surface region at the outer periphery of the skirt portion 10 overlapping extending directions of the left and right piston pin boss portions 15 and 14.

There can be fluxes of oil (as oil 04 indicated by broken lines) introduced through the lower left or right innermost vertical groove 43B or 43B, or from over a sub-region of the large clearance region 51 residing still inside of the innermost vertical grooves 43B and 43B, and passing the lower left or right oblique side of the seven-sided shape, to the intermediate clearance region 53, and conducted toward the circumferential central region 10*c* of the skirt portion 10, to introduce to the small clearance region 52.

By doing so, at the skirt portion 10, there can be favorable lubrication implemented over a combination of the small clearance region 52 and the intermediate clearance region 53, as well as over associated regions on the wall 6*a* of the cylinder bore 6.

Further, there can be fluxes of oil O3 introduced to the large clearance region 51 of the skirt portion 10, and separated to conduct from any one of upstream vertical grooves (i.e., the lower left and right vertical grooves) 42B and 43B to an associated one of downstream grooves (i.e., the upper left and right vertical grooves) 42A and 43A, or directly from a region vicinal to the bottom side to a region vicinal to the top side of the four-sided shape by one of the outermost left and right longest vertical grooves 41. By doing so, there can be fluxes of excessive oil discharged downstream of the vertical groove 41, 42B, or 43B, smoothly and without stagnation, thus allowing for dragging resistances by oil to the piston 7 to be reduced.

In particular, according to embodiments herein, the piston 7 has the left and right vertical grooves 41 continuously extending from the upper skirt part 36 to the lower skirt part 38, at regions involving largest clearances between the skirt portion 10 and the wall 6*a* of the cylinder bore 6, among regions in the large clearance region 51.

By doing so, the piston 7 in the course of reciprocation is adapted (when handling fluxes of oil as introduced to clearances at regions involving largest clearances between the skirt portion 10 and the wall 6*a* of the cylinder bore 6, among regions in the large clearance region 51), to use the vertical grooves 41 for discharging such oil to downstream ends, thus affording to discharge the more oil to downstream ends.

On the other hands, the piston 7 is cooperative with the wall 6 of the cylinder bore 6 to introduce in between a flow of oil proportional to a speed of the piston 7. Therefore, in a low rotation speed range of the engine 1, such the flow of oil is decreased, with anxieties about deteriorated lubrication between the wall 6 of the cylinder bore 6 and the small clearance region 52 and the intermediate clearance region 53.

Further, in a high rotation speed range of the engine 1, the piston 7 has an increased flow of oil introduced between the large clearance region 51 and the wall 6 of the cylinder bore 6, giving rise to an increased drag resistance to the piston 7 by oil.

According to embodiments herein, the piston 7 is adapted in the low rotation speed range of the engine 1, to have a sufficient flow of oil introduced from the vertical grooves 42A, 42B, 43A, and 43B, to clearances between the wall 6 of the cylinder bore 6 and the small clearance region 52 and the intermediate clearance region 53, allowing for an enhanced lubrication between the wall 6 of the cylinder bore 6 and the small clearance region 52 and the intermediate clearance region 53.

Further, the piston 7 is adapted in the high rotation speed range of the engine 1, to have a flow of oil introduced to clearances between the large clearance region 51 and the wall 6 of the cylinder bore 6, and discharged through the vertical grooves 41, 42A, 42B, 43A, and 43B, to downstream ends, smoothly and without stagnation, allowing for a reduced drag resistance to the piston 7 by oil. Such being the case, the piston 7 is adapted to make lubrication to the skirt portion 10 compatible with reduction of drag resistance to the piston 7, irrespective of the rotation speed of the engine 1 to be increased or decreased.

Figure 14:
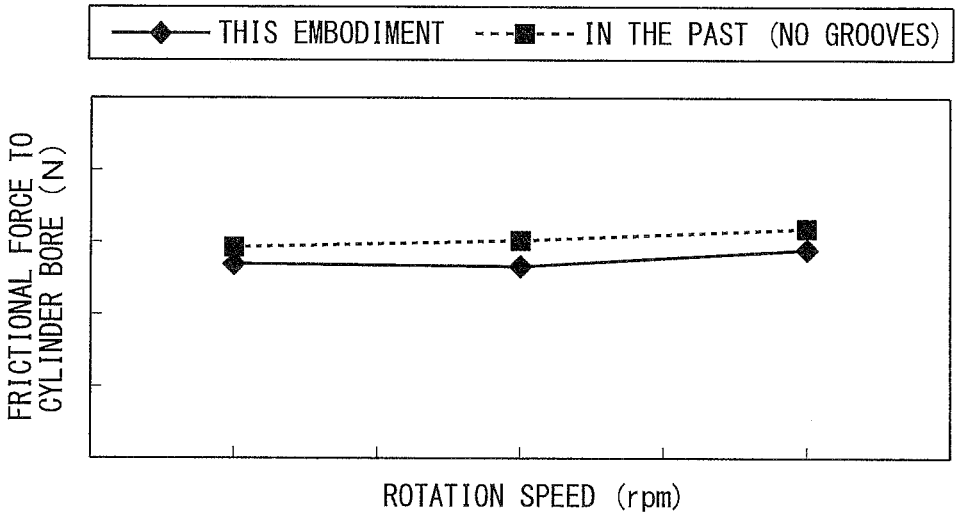
FIG. 14 is a graph comparing a piston having vertical grooves formed therein according to an embodiment of this invention and a piston in the past having no vertical grooves, with respect to a piston performance defined by a relationship between an engine revolution speed and a frictional force produced between a wall of a cylinder bore and skirt portions of a piston.

FIG. 14 is a data on experiments including measuring frictional forces between a wall of a cylinder bore and skirt portions using resin coat films in the past having no vertical grooves formed therein or those using resin coat films 39 involving vertical grooves 41 and the lie formed therein according to embodiments herein.

This experimental data involves results of varying the rotation speed of an engine for operating a piston, using a device for evaluation of frictional forces acting on the piston proper. There was a result on a piston 7 using resin coat film layers 39 according to embodiments herein, including data on frictional forces between a wall of a cylinder bore and skirt portions, ensuring a reduction of approximately 10% in average in comparison with a piston using resin coat film layers in the past.

Such being the case, according to embodiments herein, a resin coat film 39 formed on a skirt portion 10 of a piston 7 has a four-sided outer peripheral region knurled at upper and lower regions thereof corresponding in a rear view of the piston 7 to an upper skirt part 36 and a lower skirt part 38 of the skirt portion 10 extending in parallel with an axial direction of left and right piston pin boss portions 15 and 14, with a combination of short vertical grooves 43A and 43B and medium-length vertical grooves 42A and 42B extending in parallel with a central axis C of a piston crow portion 9, and at left and right edge regions thereof, with long vertical grooves 41.

In other words, the rear skirt portion 10 composed of the upper skirt part 36, the central skirt part 37, and the lower skirt part 38 (thus involving at least the upper skirt part 36 and the lower skirt part 38) has the resin coat film 39 formed on an peripheral surface thereof, and knurled at a four-sided outer peripheral region thereof with two sets of five vertical grooves 41, 42A, 42B, 43, and 43B extending in parallel with the central axis C of the piston crown portion 9. Those vertical grooves 41, 42A, 42B, 43, and 43B are located within ranges in extending directions of the left and right piston pin boss portions 15 and 14, (that is, overlapping them 15 and 14) when viewed from behind in a vehicle-longitudinal direction perpendicular to the central axis C of the piston crown portion 9.

By doing so, during reciprocation of the piston 7, there can be fluxes of oil introduced between the wall 6*a* of the cylinder bore 6 and a central region on the peripheral surface of the skirt portion 10 that undergoes small clearances and high contact pressures, when contacting an associated region on the wall 6*a* of the cylinder bore 6. This situation permits lubrication between the skirt portion 10 and the wall 6*a* of the cylinder bore 6 to be enhanced, allowing for a prevented seizing between the skirt portion 10 and the wall 6*a* of the cylinder bore 6.

Further, according to embodiments herein, at the piston 7, there can be an ample flux of oil introduced between the large clearance region 51 of the skirt portion 10 and the wall 6*a* of the cylinder bore 6, and discharged downstream of movement of the piston 7 by vertical grooves 41, 42A, 42B, 43, and 43B, smoothly without stagnation. By doing so, dragging resistances by oil to the piston 7 can be reduced, affording to prevent fuel economy of the engine 1 from getting worse.

Further, according to embodiments herein, at the piston 7, the skirt portion 10 is configured to have increased curvatures, as it circumferentially extends from the circumferential central region 10*c* toward the left and right side wall portions 13 and 12. Accordingly, the skirt portion 10 has decreased clearances to the wall 6*a* of the cylinder bore 6, as it extends either of the left side part 10*a* and the right side part 10*b* of the skirt portion 10 toward the circumferential central region 10*c*.

And, the sets of five vertical grooves are each disposed to have the vertical groove 41, the vertical groove 42A or 42B, and the vertical groove 43A or 43B mutually neighboring in a circumferential direction of the skirt portion 10. The vertical groove 41 disposed nearer to the side wall portion 12 or 13 is knurled with a greater length than the vertical grooves 43A and 43B disposed nearer to the circumferential central region 10*c* of the skirt portion 10 in an extending direction of the central axis C of the piston crown portion 9.

By doing so, three can be fluxes of oil smoothly introduced to the large clearance region 51 on the resin coat film 39 of the skirt portion 10, affording to employ the left and right long vertical grooves 41 and 41 to have fluxes of excessive oil, unused for lubrication, smoothly discharged downstream of the piston 7, without stagnation. Hence, dragging resistances by oil to the piston 7 can be the more effectively reduced.

Further, according to embodiments herein, at each vertical groove set of the piston 7, the upper vertical grooves 42A and 43A set shorter than the vertical groove 41 are disposed to extend between the upper edge 39*a* (see FIG. 8) of the resin coat film 39 on the skirt portion 10 and a local region just above the upper boundary 37*a* that is a boundary of the central skirt part 37 defining the upper skirt part 36.

Further, at each vertical groove set of the piston 7, the lower vertical grooves 42B and 43B set shorter than the vertical groove 41 are disposed to extend between the lower edge 39*b* (see FIG. 8) of the resin coat film 39 on the skirt portion 10 and a local region just below the lower boundary 37*b* that is a boundary of the central skirt part 37 defining the lower skirt part 38.

By doing so, there can be minute variations in clearance between the wall 6*a* of the cylinder bore 6 and the skirt portion 10 of the piston 7, so there can be fluxes of oil effectively introduced from the vertical grooves 43A and 43B to vicinities of the upper boundary 37*a* and the lower boundary 37*b* of the central skirt part 37 undergoing increased contact pressures between the wall 6*a* of the cylinder bore 6 and the skirt portion 10.

Accordingly, there can be fluxes of oil effectively introduced between the wall 6*a* of the cylinder bore 6 and the central skirt part 37, allowing for effective lubrication to the wall 6*a* of the cylinder bore 6 and the central skirt part 37.

Further, according to embodiments herein, at the piston 7, the vertical grooves 41, 42A, 42B, 43A, and 43B are knurled with a depth of 10 μm allowing for smooth communication of oil to the vertical grooves 41, 42A, 42B, 43A, and 43B. The vertical grooves 41, 42A, 42B, 43A, and 43B may well have depths thereof within a range of 10 μm or more and 20 μm or less.

At the vertical grooves 41, 42A, 42B, 43A, and 43B, if given a depth of 5 μm or less, the vertical grooves 41, 42A, 42B, 43A, and 43B may constitute a difficulty for oil to be conducted, and may be unfavorable. Or, if given a depth of 20 μm or more, the vertical grooves 41, 42A, 42B, 43A, and 43B may cause the resin coat film 38 to have an increased thickness, leading to stagnation of excessive oil, and may be unfavorable.

While embodiments of this invention have been described, it is apparent that some artisan could have made changes without departing from the scope of this invention. It is intended that any and all such modifications and equivalents are involved in the appended claims.

The invention claimed is:

1. A piston for internal combustion engines comprising:

a piston body;

a pair of skirt portions hanging down from the piston body;

a pair of piston pin boss portions hanging down from the piston body and configured to hold a piston pin;

a pair of side wall portions configured to interconnect the pair of skirt portions and the pair of piston pin boss portions; and a resin coat film provided on an outer periphery of one skirt portion of the pair of skirt portions, the one skirt portion comprising:

a central skirt part having an outside diameter thereof maximized at a central part thereof with respect to an extending direction of a central axis of the piston body;

an upper skirt part residing above an upper boundary of the central skirt part, and curved to have an outside diameter thereof gradually decreased, as the upper skirt part extends from the upper boundary toward the central axis of the piston body; and a lower skirt part residing below a lower boundary of the central skirt part, and curved to have an outside diameter thereof gradually decreased, as the lower skirt part extends from the lower boundary toward the central axis of the piston body, the one skirt portion being configured to have increased curvatures, as the one skirt portion circumferentially extends from a circumferential central region on the one skirt portion toward the pair of side wall portions, the resin coat film comprising a region thereon corresponding to a combination involving at least the upper skirt part and the lower skirt part, the region on the resin coat film being knurled with a set of vertical grooves extending in parallel with the central axis of the piston body, the set of vertical grooves residing within an outer peripheral range of the resin coat film corresponding to extending directions of the pair of piston pin boss portions with respect to a direction perpendicular to the central axis of the piston body.

2. The piston for internal combustion engines according to claim 1, wherein the set of vertical grooves comprises a first subset thereof involving first and second vertical grooves mutually neighboring in a circumferential direction of the one skirt portion, the first vertical groove being nearer to the circumferential central region of the one skirt portion and shorter in the extending direction of the central axis of the piston body, than the second vertical groove.

3. The piston for internal combustion engines according to claim 2, wherein the set of vertical grooves has the first subset thereof residing in a first outer peripheral region of the resin coat film corresponding to the upper skirt part of the one skirt portion.

4. The piston for internal combustion engines according to claim 3, wherein the set of vertical grooves comprises a second subset thereof involving third and fourth vertical grooves mutually neighboring in the circumferential direction of the one skirt portion, the third vertical groove being nearer to the circumferential central region of the one skirt portion and shorter in the extending direction of the central axis of the piston body, than the fourth vertical groove, wherein the set of vertical grooves has the second subset thereof residing in a second outer peripheral region of the resin coat film corresponding to the lower skirt part of the one skirt portion.

5. The piston for internal combustion engines according to claim 1, wherein the set of vertical grooves comprises vertical grooves having depths thereof within a range of 5 μm to 20 μm.

* * * * *